US007145509B2

(12) United States Patent
Ikuta et al.

(10) Patent No.: US 7,145,509 B2
(45) Date of Patent: Dec. 5, 2006

(54) ARRAY ANTENNA AND RADIO COMMUNICATION APPARATUS USING THE SAME

(75) Inventors: Takanori Ikuta, Kyoto (JP); Akinori Sato, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 11/059,144

(22) Filed: Feb. 16, 2005

(65) Prior Publication Data

US 2005/0181748 A1 Aug. 18, 2005

(30) Foreign Application Priority Data

Feb. 17, 2004 (JP) ..... P2004-040042
Feb. 17, 2004 (JP) ..... P2004-040043

(51) Int. Cl.
*H01Q 1/38* (2006.01)

(52) U.S. Cl. ..... 343/700 MS; 343/853; 333/126

(58) Field of Classification Search ..... 343/700 MS, 343/853; 342/375; 333/126
See application file for complete search history.

(56) References Cited

U.S. PATENT DOCUMENTS 5,543,765 A * 8/1996 Cachier ..... 333/246
5,694,498 A * 12/1997 Manasson et al. ..... 385/15
6,496,147 B1 * 12/2002 Kirino ..... 342/700 MS
6,549,164 B1 * 4/2003 Paschen et al. ..... 342/371
6,791,507 B1 * 9/2004 Johansson et al. ..... 343/853
6,828,932 B1 * 12/2004 Jenabi ..... 342/188
7,026,887 B1 * 4/2006 Watanabe et al. ..... 333/126
2005/0012665 A1 * 1/2005 Runyon et al. ..... 342/372
2005/0190018 A1 * 9/2005 Kawai et al. ..... 333/235
2005/0207518 A1 * 9/2005 Toncich et al. ..... 375/347

FOREIGN PATENT DOCUMENTS

JP 2002-528899 9/2002
JP 2002-299952 10/2002
WO WO 00/24079 4/2000

OTHER PUBLICATIONS

* Japanese Publication No. 2002-528899 corresponds to International Publication No. WO 00/24079, Sep. 3, 2002.

* cited by examiner

*Primary Examiner*—Hoanganh Le
*Assistant Examiner*—Tung Le
(74) *Attorney, Agent, or Firm*—Hogan & Hartson LLP

(57) ABSTRACT

A directivity controllable array antenna with a variable phase shifter is provided which is stable and has a small waveform and intermodulation distortion, excellent high power handling capability and low-loss. In an array antenna with a variable phase shifter, the variable phase shifter has a transmission line, and a variable capacitance capacitor is connected to a terminal of a ground side of the transmission line. In the variable capacitance capacitor, a plurality of variable capacitance elements each using a thin film dielectric layer whose dielectric constant changes in accordance with an applied voltage are connected between an input terminal and an output terminal, in parallel to each other with respect to direct current component and in series with each other with respect to high frequency component.

11 Claims, 13 Drawing Sheets

ARRAY ANTENNA AND RADIO COMMUNICATION APPARATUS USING THE SAME

BACKGROUND OF THE INVENTION

1. Field of the Invention

The present invention relates to a directivity controllable array antenna that is used in communication equipment of a microwave band, a millimeter wave band or the like and provided with a variable phase shifter or a variable reactance circuit, and to a radio communication apparatus using the same. More specifically the invention relates to an array antenna and a radio communication apparatus using the same in which for a variable phase shifter or variable reactance circuit is used a variable capacitance capacitor having a dielectric layer whose dielectric constant changes in accordance with an applied voltage, which array antenna or radio communication apparatus is capable of changing a phase shifting amount or a reactance value by changing the capacitance and making the directivity of the array antenna variable, and in particular, which has excellent characteristics such as high power handling capability, low distortion and low loss, and is of low-price and easily configured.

2. Description of the Related Art

On communication equipment of a microwave band, a millimeter wave band or the like, demands for making radio communications high speed and large capacity, improving radio communication quality and realizing high speed mobile communications and so on have increased year by year. However, depending on states of a radio communication environment, multipath and a Doppler shift may cause deterioration of the radio communication quality. Moreover, because of spread and increase of mobile phones and the like in recent years, it has become necessary to increase the number of users who can simultaneously communicate.

As a solution for solving these problems, for the purpose of improving the radio communication quality and enhancing the use efficiency of a certain limited frequency so that a lot of users can use the frequency simultaneously by effective use, an adaptive array antenna technique of adaptively controlling a directivity of an antenna receives attention, and is enthusiastically examined today.

As a solution for making it possible to adaptively control a directivity of an array antenna, an array antenna that makes it possible to adaptively control the directivity by using a variable capacitance diode or a voltage-control-type dielectric varactor as a reflective termination portion and combining with a rat race coupler or the like, or by using a variable phase shifting circuit in which the voltage-control-type dielectric varactor is placed in a radial stub extending from a microstrip line, is proposed (refer to Japanese Unexamined Patent Publication JP-A 2002-528899, for example). This voltage-control-type dielectric varactor is composed of a substrate, a controllable ferroelectric layer, and first and second electrodes. The substrate has a first dielectric constant and has a substantially flat surface. The controllable ferroelectric layer has a second dielectric constant larger than the first dielectric constant and locates on the substantially flat surface of the substrate. The first and second electrodes locate on a surface of the controllable ferroelectric layer opposite to the substantially flat surface of the substrate. The first and second electrodes are separated so as to form a gap therebetween. The voltage-control-type dielectric varactor is equivalent to a variable capacitance capacitor.

However, in the related array antenna having the variable phase shifting circuit using the variable capacitance diode as a variable phase shifter, a loss at high frequencies of the variable capacitance diode is large, so that there is a problem such that an electric power loss in the variable phase shifting circuit becomes large, and consequently, a loss of the array antenna becomes large.

Further, the related array antenna having the variable phase shifting circuit using the variable capacitance diode has a problem such that it can be used only in a receiver, a reception circuit and the like that handle small electric power, because high power handling capability of the variable capacitance diode is low, and a distortion of signals resulting from nonlinearity of a capacitance is large. In other words, the related array antenna has a problem such that it cannot be used in a transmitter and a transmission circuit that handle large electric power.

Additionally, in the related array antenna having the variable phase shifting circuits using the variable capacitance diodes, as shown by an equivalent circuit diagram of an example of the variable phase shifting circuit in FIG. 14, bias signals are supplied from a bias terminal V via a bias supply circuit G to variable capacitance diodes 301 and 302, so that the variable phase shifting circuit needs the independent bias supply circuit G composed of choke coils L1 and L2. Therefore, it is necessary to design the bias supply circuit G, it is necessary to take time for regulation thereof, and moreover, the variable phase shifting circuit and the bias supply circuit G are configured separately, so that there is a problem such that the area of the circuits becomes large and the array antenna apparatus becomes large in size as a whole. In respect of the need for the bias supply circuit G, the same problem is caused in the array antenna having the related variable phase shifting circuits even if the variable capacitance diodes are replaced with variable capacitance capacitors.

Besides, in the array antenna having the variable phase shifting circuits using the variable capacitance diodes, the variable capacitance diodes 301 and 302 have polarities with respect to applied voltages, so that there is a problem such that it is necessary to pay attention to the polarities not only at the time of designing but also packaging and it takes time to mount.

Furthermore, in the related variable phase shifting circuit using the voltage-control-type dielectric varactor as proposed in JP-A 2002-528899, the voltage-control-type dielectric varactor corresponding to the variable capacitance capacitor causes a capacitance variation even by a high-frequency voltage, so that there is a problem such that, in a case where the high-frequency voltage is high, distortion characteristics such as a waveform distortion and an intermodulation distortion of the variable phase shifting circuit become large. Moreover, in order to make the distortion characteristics small, it is necessary to lower a high-frequency electric field strength of the variable capacitance capacitor and decrease the capacitance variation by the high-frequency voltage, and it is effective therefor to broaden a gap of a capacitance forming portion. However, there is a problem such that since a direct current electric field strength also lowers when the gap of the capacitance forming portion is broadened, a capacitance change ratio also lowers and a variable width of a phase shifting amount of the variable phase shifting circuit decreases.

Still further, since an electric current easily flows to the variable capacitance capacitor in the case of high frequency signals, when the variable capacitance capacitor is used at high frequencies, the variable capacitance capacitor generates heat because of a loss resistance and breaks down, so that there is a problem such that high power handling capability of the variable phase shifting circuit is low. It is also effective for the problem of the high power handling capability to broaden the gap of the capacitance forming portion (increase the thickness of a dielectric layer) and reduce a heat generation amount per unit volume. However, when the gap of the capacitance forming portion is broadened (the thickness of the dielectric layer is increased), the direct current electric field strength is also reduced, so that there is a problem such that the capacitance change ratio also lowers and the variable width of the phase shifting amount of the variable phase shifting circuit decreases. In the case of applying the variable phase shifting circuit to the array antenna, it is necessary to connect a variable phase shifting circuit having a large component size for each antenna element of the array antenna, so that there is a problem such that the array antenna becomes large in size.

Further, as a directional antenna in which a radiation element to be fed and a reflector or director serving as a parasitic element are placed in specified positions and combined, a Yagi-Uda antenna is typical, and an array antenna apparatus in which a plurality of parasitic radiation elements excited by mutual coupling are placed around a radiation element to be excited and variable reactance elements are loaded on the parasitic radiation elements and which can control a directivity by changing reactance values of the variable reactance elements, is proposed (refer to Japanese Unexamined Patent Publication JP-A 2002-299952, for example). The array antenna apparatus is provided with the driven element, and a plurality of variable reactance circuits disposed on each of the parasitic elements, and the array antenna is configured so as to cause the plurality of parasitic elements to operate as the directors or reflectors and change the directivity of the array antenna by changing the reactance values of each of the variable reactance circuits. The variable reactance circuits use a variable capacitance diode serving as the variable reactance element, and the variable capacitance diode corresponds to a variable capacitance capacitor.

Furthermore, at least one pair of variable reactance elements such that the variable capacitance diodes are connected in the opposite direction to each other are used in the variable reactance circuit, and by restraining a nonlinear distortion such as the second harmonic of the variable capacitance diode and connecting a plurality of pairs of variable reactance elements in parallel, an array antenna for large electric power that can withstand a large electric current is realized.

However, in the related directivity controllable array antenna, the variable reactance circuit uses at least the one pair of variable reactance elements such that the variable capacitance diodes are connected in the opposite direction to each other. In the related array antenna having the variable reactance circuit, a loss at high frequencies of the variable capacitance diode is large, so that there is a problem such that a loss of the variable reactance circuit becomes large, and consequently, a loss of the array antenna becomes large.

Further, in the variable reactance circuit, in order to withstand a large electric current, it is necessary to connect the plurality of pairs of variable reactance circuits in parallel, and it is necessary to increase the pairs of variable reactance circuits by connecting a plurality of pairs in parallel as a handled electric current becomes large. In this case, there is a problem such that a loss of the variable reactance circuits further increases.

Furthermore, the variable reactance circuit loaded on the parasitic element needs at least the one pair of variable reactance elements such that the variable capacitance diodes are connected in the opposite direction to each other, and the array antenna apparatus has a problem such that the number of steps for mounting the variable reactance elements increases, the cost of components increases, and because of an increase of a component count, an influence of variations in the components increases.

Still further, in order to get ready for a large electric current, it is necessary to increase the number of the variable reactance elements connected in parallel, so that such a problem is caused in this case that the number of the steps for mounting the variable reactance elements further increases, the cost of the components increases, and the influence of the variations in the components due to the increase of the component count further increases.

Additionally, in the array antenna having the variable reactance circuits using the variable capacitance diodes, as shown by an equivalent circuit diagram of the variable reactance circuit loaded on a dipole-type parasitic element in FIG. 15, bias signals are supplied from bias terminals Vc− and Vc+ via bias supply circuits G1 and G2 to a pair of variable capacitance diodes 301 and 302, so that the variable reactance circuit needs the independent bias supply circuits G1 and G2 composed of resistors R1, R2 and R3. Therefore, it is necessary to design the bias supply circuits G1 and G2, it is necessary to take time for regulation thereof, and moreover, the variable reactance circuit and the bias supply circuits G1 and G2 are configured separately, so that there is a problem such that the area of the circuits becomes large and the array antenna apparatus becomes large in size as a whole. In respect of the need for the bias supply circuits, the same problem is caused in the array antenna having the related variable reactance circuits even if the variable capacitance diodes are replaced with variable capacitance capacitors.

Besides, in the array antenna having the variable reactance circuits using the variable capacitance diodes, the variable capacitance diodes 301 and 302 have polarities with respect to applied voltages, so that there is a problem such that it is necessary to pay attention to the polarities not only at the time of designing but also packaging and it takes time to package.

SUMMARY OF THE INVENTION

The invention is created in consideration of the problems of the related arts as described above, and an object thereof is to provide an array antenna that has excellent characteristics such as high power handling capability, low distortion and low loss, and is of low-price and simply configured, and provide a radio communication apparatus using the same.

Further, another object of the invention is to provide an array antenna having a variable phase shifter or a variable reactance circuit that does not need an independent bias supply circuit for a variable capacitance element and is easy to handle, and provide a radio communication apparatus using the same.

The invention provides an array antenna comprising:

a plurality of radiation elements;

a plurality of feeding lines that feed electric power to the plurality of radiation elements; and variable phase shifters each inserted midway between the feeding lines, wherein the phase shifter has a transmission line or a circulator, a variable capacitance capacitor is connected to a ground side of the transmission line or a ground side terminal of the circulator, and in the variable capacitance capacitor, a plurality of variable capacitance elements each using a thin film dielectric layer whose dielectric constant changes in accordance with an applied voltage are connected between an input terminal and an output terminal, in parallel to each other with respect to direct current component and in series with each other with respect to high frequency component.

Further, in the invention, the variable capacitance capacitor used in the variable phase shifter has a bias supply circuit that is connected to electrodes of the plurality of variable capacitance elements and includes at least one of a resistance component and an inductor component.

In the invention, the radiation element is a microstrip antenna or a planar inverted-F antenna.

In the invention, the plurality of radiation elements are connected in parallel to a single power feeding source by the plurality of feeding lines.

In the invention, the thin film dielectric layer is a dielectric layer made of a perovskite oxide crystal containing at least Ba, Sr and Ti.

The invention provides a radio communication apparatus comprising:

the array antenna of the invention; and at least one of a transmission circuit and a reception circuit, the one being connected to the array antenna.

According to the invention, the array antenna comprises the plurality of radiation elements, the plurality of feeding lines that feed electric power to the plurality of radiation elements, and the phase shifters each inserted midway between the feeding lines. The phase shifter has the transmission line or the circulator, and the variable capacitance capacitor is connected to the ground side of the transmission line or the ground side terminal of the circulator. In the variable capacitance capacitor, the plurality of variable capacitance elements each using the thin film dielectric layer whose dielectric constant changes in accordance with an applied voltage are connected between the input terminal and the output terminal, in parallel to each other with respect to direct current component and in series with each other with respect to high frequency component. Therefore, in the variable capacitance capacitor of the variable phase shifter, the plurality of variable capacitance elements are connected in parallel to each other direct current component so that it is possible to apply specified bias signals to the respective variable capacitance elements. By the configuration, it becomes possible to obtain a desired phase shifting amount by making the maximum use of capacitance change ratio of each of the variable capacitance elements that depends on the bias signal and adaptively changing the phase of a signal inputted to or outputted from the variable phase shifter, and it is possible to synthesize directivities as desirable for the array antenna.

Further, according to the invention, since in the variable capacitance capacitor used in the variable phase shifter, the plurality of variable capacitance elements are connected in series with each other with respect to high frequency component, a high frequency voltage applied to the variable capacitance elements is divided into each of the variable capacitance elements. Thus, high frequency voltages applied to the individual variable capacitance elements decrease because of the division, and consequently, it is possible to hold down a capacitance variation with respect to a high frequency signal of the variable capacitance capacitor so as to be small. Therefore, it is possible to extensively restrain a waveform distortion, an intermodulation distortion and the like of the variable phase shifter, and it is possible to improve distortion characteristics of the array antenna. In addition, according to the invention, in the variable capacitance capacitor used in the variable phase shifter, the plurality of variable capacitance elements are connected in series with each other with respect to high frequency component, so that it is possible to obtain the same effect as in the case of increasing film thickness of the dielectric layer of the variable capacitance element, and it is possible to reduce a heat generation amount per unit volume due to a loss resistance of the variable capacitance capacitor. As a result, high power handling capability of the variable phase shifter increases, and it is possible to improve a high power handling capability characteristic of the array antenna.

Further, according to the invention, the variable capacitance element using the thin film dielectric layer whose dielectric constant changes in accordance with an application voltage is utilized in the variable capacitance capacitor used in the variable phase shifter. Thereby, as compared with a case of using a variable capacitance diode serving as a barrier capacitance as the variable capacitance element, it is possible to reduce a loss in the variable capacitance capacitor even at high frequencies. Consequently, a passing characteristic of the variable phase shifter is improved, and attending thereon, it is possible to improve a passing characteristic of the array antenna.

Furthermore, according to the invention, when the variable capacitance capacitor used in the variable phase shifter has the bias supply circuit that is connected to the electrodes of the plurality of variable capacitance elements and includes at least one of the resistance component and the inductor component, an independent bias supply circuit mounted on an external wiring board as in the related variable phase shifting circuit becomes unnecessary, and miniaturization of the variable phase shifter is realized. Thus, it becomes possible to substantially miniaturize the array antenna as a whole, and it becomes easy to handle the array antenna using the variable phase shifter.

From the above, according to the invention, it is possible to provide the array antenna with the variable phase shifter that is stable and has a small waveform distortion and intermodulation distortion, excellent high power handling capability and a low loss. Further, according to the invention, it is also possible to provide the array antenna with the variable phase shifter that does not need the independent bias supply circuit and is small in size and easy to handle.

According to the invention, the radiation element is a microstrip antenna or a planar inverted-F antenna. Therefore, the microstrip antenna and the planar inverted-F antenna are possible to obtain the miniaturized radiation element by forming a conductive material to become a radiation electrode on a base made of a magnetic material such as ferrite or on a dielectric material made of ceramics or an organic material, by a crimping method, a pressing method or a printing method, and are favorable in respect of miniaturization.

According to the invention, since the plurality of antenna elements are connected in parallel to the single power feeding source by the plurality of power feeding lines, it is possible to independently set excitation conditions of the respective radiation elements, and it is possible to facilitate designing.

According the invention, for example, by targeting on a dielectric material that a perovskite oxide crystal can be obtained from, film-formation by a sputtering method is performed until desired thickness is obtained, and at this moment, by performing the high-temperature sputtering at a high substrate-temperature of, for example, 800° C., it is possible to obtain the thin film dielectric layer of low loss that has a high dielectric constant and a high capacitance change ratio, without performing heat treatment after the sputtering.

According to the invention, the radio communication apparatus comprises the array antenna of the invention, and at least one of the transmission circuit and the reception circuit, the one being connected to the array antenna. Consequently, it becomes possible, by the array antenna with the variable phase shifter that is stable and has a small waveform distortion and intermodulation distortion, excellent high power handling capability and low-loss, to use a transmitter and a transmission circuit that handle large electric power. Thus, the radio communication apparatus that can reduce deterioration of the quality of radio communications by multipath, a Doppler shift and the like can be realized. Moreover, since the configuration of the antenna can be miniaturized, the radio communication apparatus with the array antenna also can be miniaturized, and can be used for a mobile radio equipment.

The invention provides an array antenna comprising:

a radiation element to which a power feeding source is connected;

a parasitic radiation element fed by mutual coupling with the radiation element; and a variable reactance circuit loaded on the parasitic radiation element, wherein the variable reactance circuit has a variable capacitance capacitor, and in the variable capacitor, a plurality of variable capacitance elements each using a thin film dielectric layer whose dielectric constant changes in accordance with an applied voltage are connected between an input terminal and an output terminal, in parallel to each other with respect to direct current component and in series with each other with respect to high frequency component.

Further, in the invention, the variable capacitance capacitor used in the variable reactance circuit has a bias supply circuit that is connected to electrodes of the plurality of variable capacitance elements and includes at least one of a resistance component and an inductor component.

In the invention, the radiation element and the parasitic radiation element are a microstrip antenna or a planar inverted-F antenna.

In the invention, the thin film dielectric layer is a dielectric layer made of a perovskite oxide crystal containing at least Ba, Sr and Ti.

The invention provides a radio communication apparatus comprising:

the array antenna of the invention; and at least one of a transmission circuit and a reception circuit, the one being connected to the array antenna.

According to the invention, the array antenna comprises the radiation element to which the power feeding source is connected, the parasitic radiation element fed by the mutual coupling with the radiation element, and the variable reactance circuit loaded on the variable reactance circuit. The variable reactance circuit has the variable capacitance capacitor, and in the variable capacitor, the plurality of variable capacitance elements each using the thin film dielectric layer whose dielectric constant changes in accordance with an applied voltage are connected between the input terminal and the output terminal, in parallel to each other with respect to direct current component and in series with each other with respect to high frequency component. Thus, the plurality of variable capacitance elements are connected in parallel to each other with respect to direct current component in the variable capacitance capacitor, so that it is possible to apply specified bias signals to the respective variable capacitance elements. Consequently, it is possible to obtain a desired directivity of the array antenna by making the maximum use of capacitance change ratio of each of the variable capacitance elements that depends on the bias signal and changing a reactance value of the variable reactance circuit.

Further, according to the invention, since in the variable capacitance capacitor used in the variable reactance circuit, the plurality of variable capacitance elements are connected in series with each other with respect to high frequency component, a high frequency voltage applied to the variable capacitance elements is divided into each of the variable capacitance elements. Thus, high frequency voltages applied to the individual variable capacitance elements decrease because of the division, and consequently, it is possible to hold down a capacitance variation with respect to a high frequency signal of the variable capacitance capacitor so as to be small. Therefore, it is possible to extensively restrain a waveform distortion, an intermodulation distortion and the like of the variable reactance circuit, and it is possible to improve distortion characteristics of the array antenna. In addition, according to the invention, in the variable capacitance capacitor used in the variable reactance circuit, the plurality of variable capacitance elements are connected in series with each other with respect to high frequency component, so that it is possible to obtain the same effect as in the case of increasing film thickness of the dielectric layer of the variable capacitance element, and it is possible to reduce a heat generation amount per unit volume due to a loss resistance of the variable capacitance capacitor. As a result, high power handling capability of the variable reactance circuit increases, and it is possible to improve a high power handling capability characteristic of the array antenna.

Further, according to the invention, the variable capacitance element using the thin film dielectric layer whose dielectric constant changes in accordance with an application voltage is utilized in the variable capacitance capacitor used in the variable reactance circuit. Thereby, as compared with a case of using a variable capacitance diode serving as a barrier capacitance as the variable capacitance element, it is possible to reduce a loss in the variable capacitance capacitor even at high frequencies. Thus, a passing characteristic of the variable reactance circuit is improved, and attending thereon, it is possible to improve a passing characteristic of the array antenna.

Furthermore, according to the invention, when the variable capacitance capacitor used in the variable reactance circuit has the bias supply circuit that is connected to the electrodes of the plurality of variable capacitance elements and includes at least one of the resistance component and the inductor component, an independent bias supply circuit mounted on an external wiring board as in the related variable reactance circuit becomes unnecessary, and miniaturization of the variable reactance circuit is realized. Thus, it becomes possible to substantially miniaturize the array antenna as a whole, and it becomes easy to handle the array antenna using the variable reactance circuit.

From the above, according to the invention, it is possible to control the reactance value of the parasitic radiation element by making the maximum use of the capacitance change ratio of the variable capacitance capacitor depending on the bias signal, and control the directivity of the radiation element and the parasitic radiation element, and it is possible to provide the array antenna that has a small waveform distortion and intermodulation distortion and excellent characteristics such as high power handling capability, a low distortion and a low loss, and is of low-price and configured simply, and provide the radio communication apparatus using the same.

Further, according to the invention, it is possible to provide the array antenna that does not need the independent bias supply circuit and uses the variable reactance circuit that is small in size and easy to handle.

According to the invention, the radiation element and the parasitic radiation element are a microstrip antenna or a planar inverted-F antenna. Therefore, the microstrip antenna and the planar inverted-F antenna are possible to obtain the miniaturized radiation element by forming a conductive material to become a radiation electrode on a base made of a magnetic material such as ferrite or on a dielectric material made of ceramics or an organic material, by a crimping method, a pressing method, a printing method or the like, and are favorable in respect of miniaturization.

According the invention, for example, by targeting on a dielectric material that a perovskite oxide crystal can be obtained from, film-formation by a sputtering method is performed until desired thickness is obtained, and at this moment, by performing the high-temperature sputtering at a high substrate-temperature of, for example, 800° C., it is possible to obtain the thin film dielectric layer of low loss that has a high dielectric constant and a high capacitance change ratio, without performing heat treatment after the sputtering.

According to the invention, the radio communication apparatus comprises the array antenna of the invention, and at least one of the transmission circuit and the reception circuit, the one being connected to the array antenna. Thus, it becomes possible, by the array antenna with the variable reactance circuit that is stable and has a small waveform distortion and intermodulation distortion, excellent high power handling capability and low-loss, to use a transmitter and a transmission circuit that handle large electric power, it is possible to easily control the directivity even in an area where a radio communication environment is unfavorable because of existence of multipath and a Doppler shift, and consequently, it becomes possible to establish radio communications without deterioration of the quality of radio communications. Moreover, in the case of applying it to a base station and a mobile station of mobile phones or the like, it becomes possible to make radio communications high speed and large capacity, improve the quality of radio communications and realize high speed mobile communications, a lot of users can use simultaneously because the use efficiency of a frequency enhances, and it is possible to provide the radio communication apparatus of small size and high performance.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
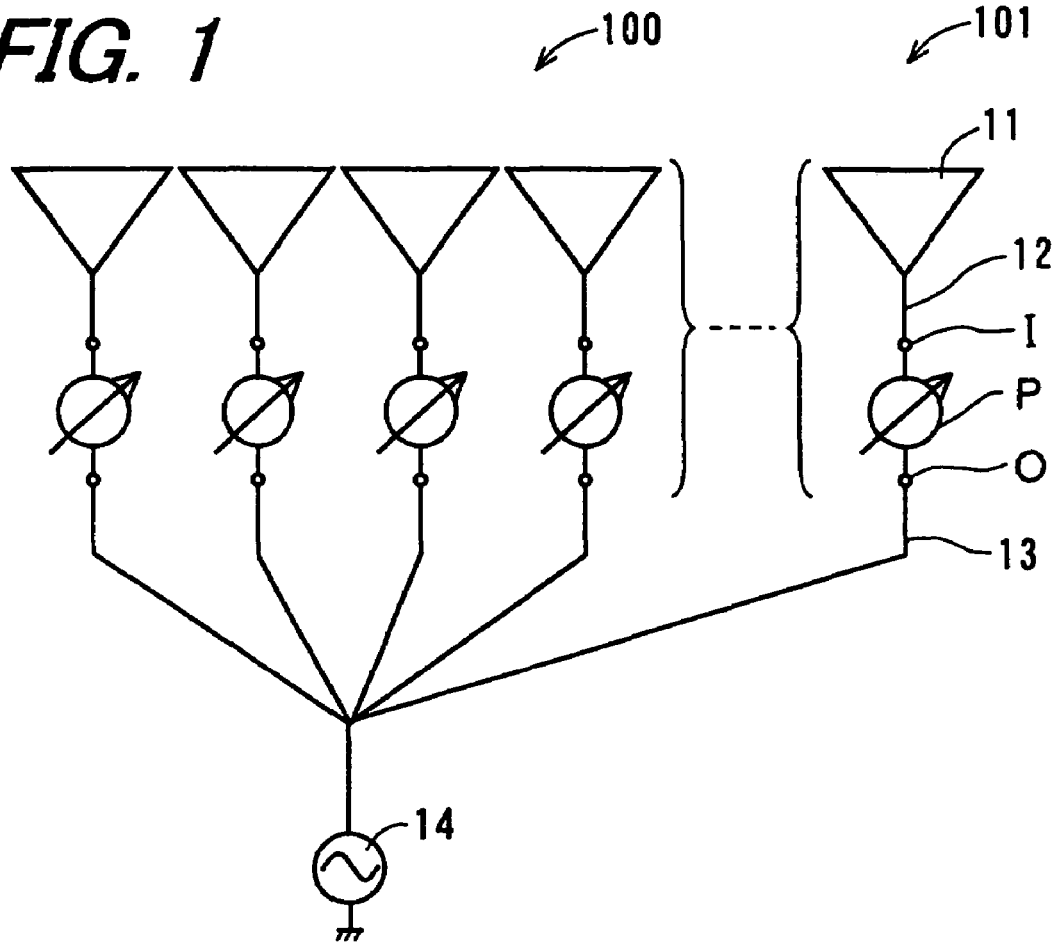
FIG. 1 is a circuit diagram schematically showing an array antenna according to a first embodiment of the invention.

Below, an array antenna and a radio communication apparatus of the invention will be described in detail referring to the drawings.

Figure 2:
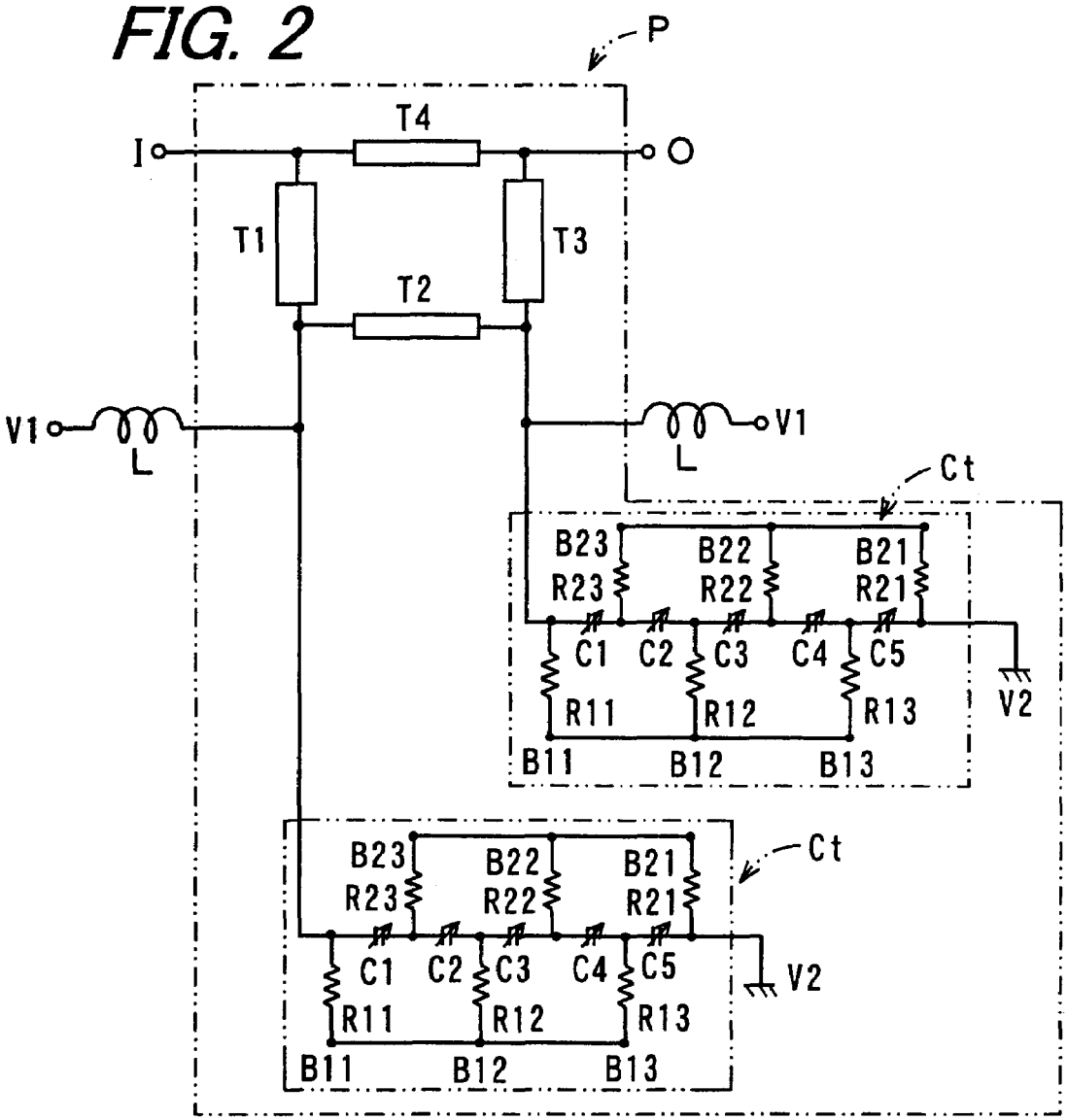
FIG. 2 is an equivalent circuit diagram showing an example of a variable phase shifter used in the array antenna of the invention.
Figure 3:
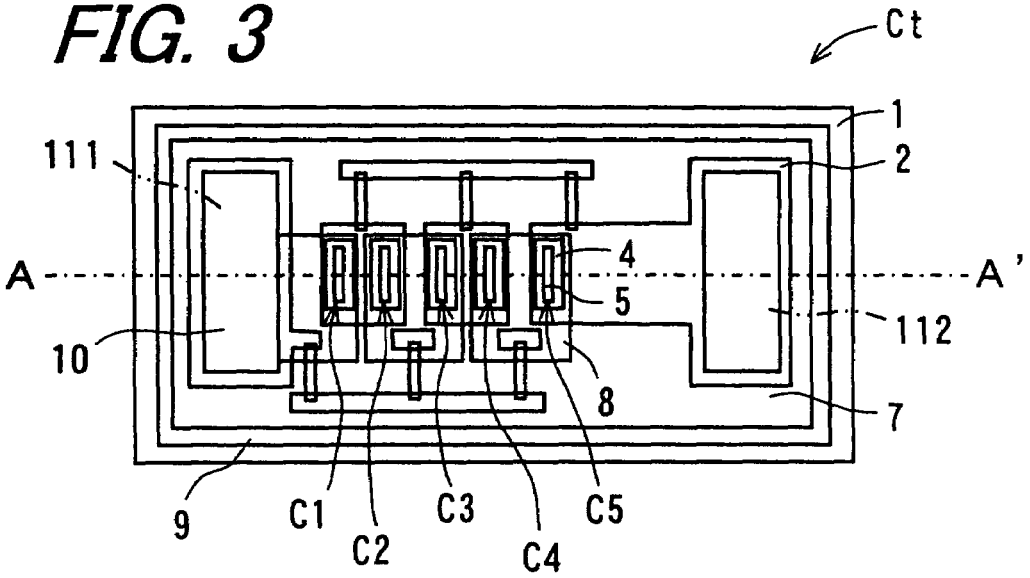
FIG. 3 is a plan view in a sight-through state showing an example of a variable capacitance capacitor including five variable capacitance elements.
Figure 4:
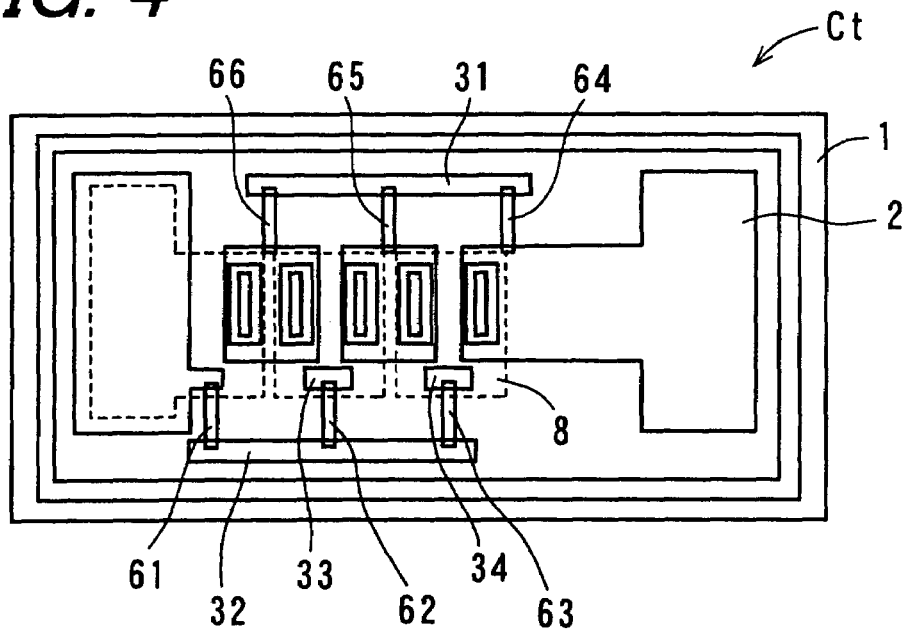
FIG. 4 is a plan view showing a state on the way of producing the variable capacitance capacitor shown in FIG. 3.
Figure 5:
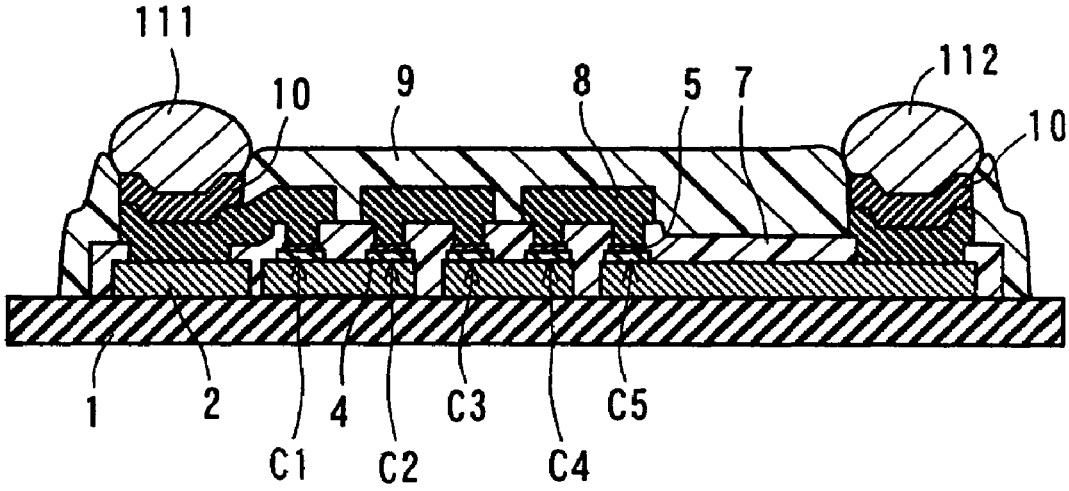
FIG. 5 is a cross sectional view taken along a line A–A' of FIG. 3.

FIGS. 1 to 5 show an array antenna according to a first embodiment of the invention. FIG. 1 is a circuit diagram schematically showing an array antenna of the invention provided with a variable phase shifter. Moreover, FIG. 2 is an equivalent circuit diagram of the 90-degree hybrid variable phase shifter P using a variable capacitance capacitor having five variable capacitance elements. Furthermore, FIGS. 3 to 5 show an example of the variable capacitance capacitor having the five variable capacitance elements, FIG. 3 is a plan view in a sight-through state, FIG. 4 is a plan view showing a state on the way of production, and FIG. 5 is a cross sectional view taken along a line A–A' of FIG. 3.

An array antenna 100 comprises a plurality of radiation elements 11, a plurality of power feeding lines 12 and 13 that feed electric power to the plurality of radiation elements 11, variable phase shifters P each inserted midway between the power feeding lines 12 and 13, and a power feeding source 14.

In the circuit diagram shown in FIG. 1, the antenna element 11 serving as a radiation element is connected to one end of the power feeding line 12. Another end of the power feeding line 12 is connected to an input terminal I of the variable phase shifter P, and one end of the power feeding line 13 is connected to an output terminal O of the variable phase shifter P. Thus, the variable phase shifter P is inserted midway between the power feeding lines 12 and 13. Another end of the power feeding line 13 is connected to one end of the power feeding source 14, and another end of the power feeding source 14 is grounded to a ground. Thus, an antenna 101 having the variable phase shifter P is configured. Then, by connecting a plurality of antennas 101 to the power feeding source 14 in parallel, the array antenna 100 is configured.

The array antenna 100 of the invention thus configured has the variable phase shifters P inserted midway between the plurality of power feeding lines 12 and 13 that feed electric power to the plurality of antenna elements 11, respectively. Thus, it becomes possible to adaptively change phases of transmission signals fed from the power feeding source 14 to the respective antenna elements 11 and reception signals received by the antenna elements 11, and it is possible to synthesize a desired directivity of the array antennas 100. By synthesizing the directivity, it is possible to obtain a desired directivity of the array antenna 100, and by regulating the width of a main beam of a radiation directivity, suppressing or controlling unnecessary side lobe, and changing the position of a null point in the radiation directivity, it is possible to regulate and obtain desired antenna gain.

Here, as the antenna element 11, a general antenna such as a linear antenna, a slot antenna, a loop antenna, a helical antenna, a horn antenna and a planar antenna can be used. Moreover, a whip antenna used in mobile equipment such as a recent mobile phone, a microstrip antenna, a planar inverted-F antenna or the like that are built in cases, and the like can be used. In particular, the microstrip antenna and the planar inverted-F antenna are favorable in respect of miniaturization, and it is possible to obtain the miniaturized antenna element 11 by forming a conductive material to become a radiation electrode on a base made of a dielectric material made of ceramics or an organic material or a magnetic material such as ferrite, by a crimping method, a pressing method, a plating method, a printing method or the like.

Further, as for a method for connecting the antenna elements 11 to the power feeding source 14, the plurality of antenna elements 11 are connected in parallel to the single power feeding source 14, and it is possible to independently set excitation conditions of the respective antenna elements 11, so that it is possible to facilitate designing. Moreover, although not shown here, a serial power feeding method of connecting a plurality of antenna elements in series to a single power feeding source can be used as well. However, in the case of the serial power feeding method, a circuit configuration is simple and low-loss, but coupling conditions influence mutually among the antenna elements 11, so that there is a tendency to a narrow-band antenna. Moreover, the antenna may be configured by connecting a plurality of antenna elements in series or in parallel to a plurality of power feeding sources, respectively.

Further, although a method for arranging the antenna elements 11 is not shown in concrete, it is possible to use, as the arrangement of the antenna elements 11, not only a simple one-dimensional arrangement but also a two-dimensional arrangement, a curved arrangement, a three-dimensional arrangement or the like, and it is possible to arrange so as to attain variety in consideration of a use of the array antenna 100, directivity controllability, coupling among the antenna elements 11 and so on.

In the equivalent circuit diagram of the variable phase shifter P shown in FIG. 2, reference numeral Ct denotes a variable capacitance capacitor, reference numerals C1, C2, C3, C4 and C5 denote variable capacitance elements, respectively, reference numerals B11, B12 and B13 denote first bias lines each including at least one of a resistance component and an inductor component (resistance components R11, R12 and R13 are shown in FIG. 2), and reference numerals B21, B22 and B23 denote second bias lines each including at least one of a resistance component and an inductor component (resistance components R21, R22 and R23 are shown in FIG. 2).

In the variable capacitance capacitor Ct thus configured, between an input terminal and an output terminal of the variable capacitance capacitor Ct, high frequency signals flow via the variable capacitance elements C1, C2, C3, C4 and C5 connected in series with each other. At this moment, the resistance components R11, R12 and R13 of the first bias lines B11, B12 and B13 and the resistance components R21, R22 and R23 of the second bias lines B21, B22 and B23 become large impedance components compared to an impedance of the variable capacitance elements C1, C2, C3, C4 and C5 in a frequency region of the high frequency signals, and do not affect adversely the impedance of the high frequency band.

Further, the bias signal that controls a capacitance component of the variable capacitance element C1 is supplied from the bias terminal V1 via the inductance (choke coil) L, and flows to the bias terminal V2 (the ground in this embodiment) via the variable capacitance element C1. In accordance with a voltage applied to the variable capacitance element C1, the dielectric constant of the variable capacitance element C1 becomes a specified dielectric constant, with the result that a desired capacitance component can be obtained. Since the variable capacitance elements C2, C3, C4 and C5 are connected in parallel to each other with respect to direct current component via the first bias lines B11, B12 and B13 and the second bias lines B21, B22 and B23, a bias signal having the same size with respect to direct current component is also applied thereto so that a predetermined capacitance components can be obtained.

As a result, a direct current bias signal for controlling the capacitance of the variable capacitance elements C1, C2, C3, C4 and C5 to desired values can be supplied individually to each of the variable capacitance elements C1, C2, C3, C4 and C5 in a stable manner, and dielectric constant in a thin film dielectric layer of each of the variable capacitance elements C1, C2, C3, C4 and C5 that depends on a bias signal applied can be changed as desired. Thus, in the variable capacitance capacitor Ct, capacitance component can be controlled easily. Consequently, the 90-degree hybrid circuit is composed of $\lambda/4$ transmission lines T1, T2, T3 and T4, whereby a reflective-type variable phase shifting circuit is realized. Therefore, in a case where the frequency of an input signal is f, on the assumption that an initial value of the variable capacitance capacitor Ct is $Ct_1$, by the variable capacitance capacitor Ct, the phase of an output signal changes by a phase $\theta_1=2\tan^{-1}(1/(Z_0\cdot 2\pi f\cdot Ct_1))$ with respect to the phase of the input signal. Moreover, when the capacitance value of the variable capacitance capacitor Ct is regulated to $Ct_2$ by an application voltage, the phase of the output signal changes by a phase $\theta_2=2\tan^{-1}(1/(Z_0\cdot 2\pi f\cdot Ct_2))$ with respect to the phase of the input signal. Therefore, by regulating the capacitance value of the variable capacitance capacitor Ct, a phase change (a phase shifting amount) $\theta=\theta_1-\theta_2=2\tan^{-1}(1/(Z_0\cdot 2\pi f\cdot Ct_1))-2\tan^{-1}(1/(Z_0\cdot 2\pi f\cdot Ct_2))$ is obtained. In other words, by merely regulating the capacitance value of the variable capacitance capacitor Ct by an application voltage, it is possible to make the phase shifting amount of the variable phase shifter P variable to a desired phase shifting amount.

According to the array antenna 100 provided with the variable phase shifters P, it becomes possible to adaptively change the phases of the transmission signals fed from the power feeding source 14 to the respective antenna elements 11 and the reception signals received by the antenna elements 11, and it is possible to synthesize a desired directivity of the array antenna 100. By synthesizing the directivity, it is possible to obtain a desired directivity of the array antenna 100, and by regulating the width of the main beam of the radiation directivity, suppressing or controlling the unnecessary side lobe, and changing the position of the null point in the radiation directivity, it is possible to regulate and obtain the desired antenna gain.

Further, high frequency signals inputted to the variable capacitance capacitor Ct, that is, high frequency signals inputted to the variable capacitance elements C1, C2, C3, C4 and C5 do not leak via the first bias lines B11, B12 and B13 or the second bias lines B21, B22 and B23, because the resistance components R11, R12 and R13 and R21, R22 and R23 become large impedance components compared to the impedance in a frequency region of the high frequency signals. This also makes it possible that a bias signal is applied independently to the variable capacitance elements C1, C2, C3, C4 and C5 in a stable manner. Thus, the capacitance change ratio of each of the variable capacitance elements C1, C2, C3, C4 and C5 that depends on the bias signal can be utilized to the maximum.

In other words, in the variable capacitance capacitor Ct, N variable capacitance elements (N is an integral number of two or more), herein, the five variable capacitance elements C1, C2, C3, C4 and C5 can be regarded as the variable capacitance elements connected in series with each other with respect to high frequency component.

Therefore, a high frequency voltage applied to the variable capacitance elements C1, C2, C3, C4 and C5 that are connected in series with each other is divided into each of the variable capacitance elements C1, C2, C3, C4 and C5, so that a high frequency voltage applied to each of the variable capacitance elements C1, C2, C3, C4 and C5 decreases. Consequently, it is possible to restrain a capacitance variation with respect to the high frequency signals to be a small one, and it is possible to suppress a waveform distortion, an intermodulation distortion and the like of the array antenna 100 using the variable phase shifter P.

Further, because the variable capacitance elements C1, C2, C3, C4 and C5 are connected in series, the same effect as in the case of increasing the thickness of the dielectric layer of the capacitance element is obtained with respect to high frequency component, it is possible to make a heat generation amount per unit volume due to a loss resistance of the variable capacitance capacitor Ct to be small, and it is possible to increase high power handling capability of the variable phase shifter P and the array antenna 100.

When an odd number of variable capacitance elements are used as in the variable capacitance capacitor Ct shown in FIG. 2, it is possible to make a signal terminal of the variable capacitance capacitor Ct and a bias terminal to be common, and it is possible to treat equally as a general capacitor.

In the equivalent circuit diagram shown in FIG. 2, reference numeral I denotes an input signal terminal, reference numeral O denotes an output signal terminal, and an input-output impedance $Z_0$ is 50 Ω. On this condition, reference numerals T1 and T3 denote the λ/4 transmission lines with characteristic impedances of 35.4 Ω($=Z_0/\sqrt{2}=50\ \Omega/\sqrt{2}$), reference numerals T2 and T4 denote the λ/4 transmission lines with characteristic impedances of 50 Ω ($=Z_0$), reference numeral Ct denotes the variable capacitance capacitor, and reference numeral L denotes a choke coil including an RF blocking inductance component for supplying a control voltage (a bias signal). The λ/4 transmission lines T1, T2, T3 and T4 compose the 90-degree hybrid circuit, whereby the variable phase shifter P of the reflective-type variable phase shifting circuit is realized. Here, a direct current limitation capacitance element is omitted.

In the equivalent circuit diagram of FIG. 2, on the assumption that the frequency of the input signal is f and the initial value of the variable capacitance capacitor Ct is $Ct_1$, the phase of the output signal changes by a phase $\theta_1=2\tan^{-1}(1/(Z_0\cdot 2\pi f\cdot Ct_1))$ with respect to the phase of the input signal. Moreover, when the capacitance value of the variable capacitance capacitor Ct is regulated to $Ct_2$ by an application voltage, the phase of the output signal changes by a phase $\theta_2=2\tan^{-1}(1/(Z_0\cdot 2\pi f\cdot Ct_2))$ with respect to the phase of the input signal. By regulating the capacitance value of the variable capacitance capacitor Ct, a phase change (a phase shifting amount) $\theta=\theta_1-\theta_2=2\tan^{-1}(1/(Z_0\cdot 2\pi f\cdot Ct_1))-2\tan^{1}(1/(Z_0\cdot 2\pi f\cdot Ct_2))$ is obtained. In other words, by merely regulating the capacitance value of the variable capacitance capacitor Ct by an application voltage, it is possible to make the phase shifting amount of the variable phase shifter P variable to a desired phase shifting amount, and it is possible to synthesize a desired directivity of the array antenna.

Although one embodiment of the variable phase shifter P used in the array antenna of the invention is shown here, it is possible to use by changing the configuration of the variable phase shifter P to, for example, a loaded-line type using a transmission line, a distributed-coupling and directional-coupling type, a 180-degree hybrid type or a configuration using a circulator in accordance with an object within the scope of the invention.

Next, an example of a method for producing the variable capacitance capacitor Ct composing the variable phase shifter P used in the array antenna of the invention will be described.

FIG. 3 is a plan view in a sight-through state showing an example of the variable capacitance capacitor Ct having the five variable capacitance elements C1 to C5, the variable capacitance capacitor Ct being used in the variable phase shifter P composing the array antenna of the invention, FIG. 4 is a plan view showing a state on the way of producing the variable capacitance capacitor Ct shown in FIG. 3, and FIG. 5 is a cross sectional view taken along a line A–A' of the variable capacitance capacitor Ct shown in FIG. 3.

In FIGS. 3 to 5, the variable capacitance capacitor Ct comprises a support substrate 1, a lower electrode layer 2, conductor lines 31, 32, 33 and 34, a thin film dielectric layer 4, an upper electrode layer 5, thin film resistors 61, 62, 63, 64, 65 and 66, an insulating layer 7, an extraction electrode layer 8, a protecting layer 9, and a solder diffusion preventing layer 10. The solder diffusion preventing layer 10 and a solder terminal portion 111 compose a first signal terminal (an input terminal), and the solder diffusion preventing layer 10 and a solder terminal portion 112 compose a second signal terminal (an output terminal).

The support substrate 1 is, for example, a ceramic substrate made of alumina ceramics or a single crystal substrate made of sapphire. The lower electrode layer 2, the thin film dielectric layer 4 and the upper electrode layer 5 are successively formed on the almost whole surface of the support substrate 1. After film-formation of the respective layers finishes, the upper electrode layer 5, the thin film dielectric layer 4 and the lower electrode layer 2 are successively etched into predetermined shapes.

The lower electrode layer 2 needs to have a high melting point so as to resistant to high temperatures, because high temperature sputtering is necessary in order to form the thin film dielectric layer 4. More specifically, the lower electrode layer 2 is made of a metallic material such as Pt and Pd. The lower electrode layer 2 is also formed by the high temperature sputtering. Moreover, after formed by the high temperature sputtering, the lower electrode layer 2 is heated to a temperature of 600 to 900° C., which is a temperature for sputtering the thin film dielectric layer 4, and is retained for a predetermined time until sputtering of the thin film dielectric layer 4 starts, thereby becoming a flat layer.

It is preferable that the thickness of the lower electrode layer 2 is large, in view of the resistance component from the second signal terminal to the fifth variable capacitance element C5, resistance components from the first variable capacitance element C1 to the second variable capacitance element C2, from the third variable capacitance element C3 to the fourth variable capacitance element C4, and the continuity of the lower electrode layer 2. However, in view of the adhesiveness with the support substrate 1, it is preferable that the thickness is relatively small. Therefore, the thickness of the lower electrode layer 2 is determined in consideration of both the continuity and the adhesion. More specifically, the thickness is 0.1 μm to 10 μm. When the thickness of the lower electrode layer 2 becomes less than 0.1 μm, the resistance of the lower electrode layer 2 itself becomes large, and moreover, there is a possibility that the continuity of the lower electrode layer 2 cannot be secured. On the other hand, when the thickness becomes more than 10 μm, internal stress becomes large, and there is a possibility that the adhesion with the support substrate 1 is decreased and the curvature of the support substrate 1 occurs.

It is preferable that the thin film dielectric layer 4 is a dielectric layer having high dielectric constant that is made of perovskite oxide crystal containing at least Ba, Sr and Ti. The thin film dielectric layer 4 is formed on a surface (an upper surface) of the lower electrode layer 2. For example, sputtering is performed until a film having a desired thickness can be obtained, using a dielectric material that can provide a perovskite oxide crystal as a target. At this moment, when the high-temperature sputtering is performed at a high substrate temperature, for example, at 800° C., a thin film dielectric layer 4 hasing a high dielectric constant, a large capacitance change ratio and low loss can be obtained without performing a heat treatment after sputtering.

As the material of the upper electrode layer 5, Au, which has a small resistivity, is preferable in order to reduce the resistance of this layer. However, in order to improve the adhesiveness with the thin film dielectric layer 4, it is preferable to use Pt or the like as an adhesive layer. The thickness of the upper electrode layer 5 is in the range of 0.1 μm to 10 μm. The lower limit of the thickness is set in consideration of the resistance of the upper electrode layer 5 itself, as in the case of the lower electrode layer 2. Moreover, the upper limit of the thickness is set in consideration of the adhesiveness with the thin film dielectric layer 4.

The first bias lines B11, B12 and B13 constituting a bias supply circuit are composed of the conductor lines 32, 33 and 34 and the thin film resistors 61, 62 and 63. The first bias lines B11, B12 and B13 are formed from a first bias terminal (also serving as the first signal terminal) to a connection point of the first bias terminal and the first variable capacitance element C1; to a connection point of the second variable capacitance element C2 and the third variable capacitance element C3, that is, the extraction electrode layer 8 connecting the upper electrode layer 5 of the second variable capacitance element C2 and the upper electrode layer 5 of the third variable capacitance element C3; and to a connection point of the fourth variable capacitance element C4 and the fifth variable capacitance element C5, that is, the extraction electrode layer 8 connecting the upper electrode layer 5 of the fourth variable capacitance element C4 and the upper electrode layer 5 of the fifth variable capacitance element C5, respectively.

More specifically, in the first bias lines B11, B12 and B13, the first bias terminal and the conductor line 32 are connected each other by the thin film resistor 61. The conductor line 32 and the conductor line 33 are connected each other by the thin film resistor 62. The conductor line 33 is connected to the extraction electrode layer 8 connecting the upper electrode layer 5 of the second variable capacitance element C2 and the upper electrode 5 of the variable capacitance C3. The conductor line 32 and the conductor line 34 are connected each other by the thin film resistor 63. The conductor line 34 is connected to the extraction electrode layer 8 connecting the upper electrode layer 5 of the forth variable capacitance element C4 and the upper electrode layer 5 of the fifth variable capacitance element C5.

Similarly, the second bias lines B21, B22 and B23 are constituted by the conductor line 31 and the thin film resistors 64, 65 and 66. The second bias lines B21, B22 and B23 are formed form a second bias terminal (also serving as the second signal terminal) and a connection point of the second bias terminal and the fifth variable capacitance element C5; to a connection point of the third variable capacitance element C3 and the fourth variable capacitance element C4; and to a connection point of the first variable capacitance element C1 and the second variable capacitance element C2, respectively.

More specifically, in the second bias lines B21, B22 and B23, the second bias terminal and the conductor line 31 are connected each other by the thin film resistor 64. The conductor line 31 and the connection point of the third variable capacitance element C3 and the forth variable capacitance C4 are connected each other by the thin film resistor 65. The conductor line 31 and the connection point of the first variable capacitance element C1 and the second variable capacitance C2 are connected each other by the thin film resistor 66.

The conductor lines 31, 32, 33 and 34 can be formed by a new film-forming operation after the lower electrode layer 2, the thin film dielectric layer 4 and the upper electrode layer 5 described above are formed. On this occasion, it is preferable to use a lift-off technology in order to protect the lower electrode layer 2, and the thin film dielectric layer 4 and the upper electrode layer 5 that already have been formed. Moreover, the conductor lines 31 to 34 can be formed also by patterning so as to form the conductor lines 31 to 34 at the same time when the lower electrode layer 2 is patterned.

As the material of the conductor lines 31 to 34, Au, which is low-resistance, is preferable in order to suppress a variation of the resistance of the first and second bias lines B11, B12, B13, B21, B22 and B23. However, since the resistances of the thin film resistors 61, 62, 63, 64, 65 and 66 are sufficiently high, the conductor lines may be formed in the same process and with the same material as the lower electrode layer 2, using Pt or the like.

Next, as a material of the thin film resistors 61 to 66 constituting the first and second bias lines B11, B12, B13, B21, B22 and B23, a material containing tantalum (Ta) and having a specific resistance of 1 mΩ·cm or more is preferable. Specific examples thereof include tantalum nitride (TaN), TaSiN and Ta—Si—O. For example, in the case of tantalum nitride, the thin film resistors 61 to 66 each having a desired composition ratio and resistivity can be formed by reactive sputtering in which sputtering is performed with nitrogen added, using Ta as a target.

By properly selecting the conditions of the sputtering, the thin film resistors 61 to 66 each having film thickness of 40 nm or more and a specific resistance of 1 mΩ·cm or more can be formed. Moreover, after the sputtering ends, patterning can be performed in a simple manner by performing an etching process such as reactive ion etching (RIE) after a resist is applied and processed to a predetermined shape.

In a case where the variable capacitance capacitor Ct is used at a frequency of 1 GHz, capacitances of the variable capacitance elements C1 to C5 are 5 pF, and the thin film resistors 61 to 66 are set to have a resistance value at least ten times as large as the impedances at 100 MHz of the variable capacitance elements C1 to C5 so that the impedance is not adversely affected from at least one tenth of the aforementioned frequency (that is, 100 MHz), then it is sufficient that the necessary resistance of the first and second bias lines B11, B12, B13, B21, B22 and B23 is approximately 3.2 kΩ or more. When the specific resistance ratio of each of the thin film resistors 61 to 66 in the variable capacitance capacitor Ct are 1 mΩ·cm or more, and 10 kΩ is to be obtained as the resistance values of the first and second bias lines B11, B12, B13, B21, B22 and B23, then the aspect ratio (length/width) of each of the thin film resistors 61 to 66 can be 50 or less at a thickness of 50 nm. Therefore, the thin film resistors 61 to 66 can have a realizable aspect ratio without increasing the size of the element shape.

The first and second bias lines B11, B12, B13, B21, B22 and B23 including the thin film resistors 61 to 66 are formed directly on the support substrate 1. Therefore, an insulating layer for ensuring the insulation with the lower electrode layer 2, the upper electrode layer 5 and the extraction electrode layer 8, which is necessary in the case of formation on the variable capacitance elements C1 to C5, is not necessary, and the number of layers constituting the variable capacitance elements C1 to C5 can be reduced. Furthermore, by using the thin film resistors 61 to 66 having a high resistance, the variable capacitance capacitor Ct can be produced without increasing the size of its shape.

Next, the insulating layer 7 is necessary for ensure insulation with the extraction electrode layer 8 formed thereon and the lower electrode layer 2. Moreover, the insulating layer 7 covers the first and second bias lines B11, B12, B13, B21, B22 and B23, can prevent the thin film resistors 61 to 66 from being oxidized. Therefore, the resistance values of the first and second bias lines B11, B12, B13, B21, B22 and B23 can be made constant over time, and thus reliability can be improved. The material of the insulating layer 7 preferably contains at least one selected from silicon nitride and silicon oxide in order to improve a moisture resistance. It is preferable to form the insulating layer by a chemical vapor deposition (CVD) or the like in consideration of coatability.

Further, the insulating layer 7 can be processed to a desired shape by a dry etching or the like using a regular resist. The insulating layer 7 is provided with through holes reaching the conductor lines 33 and 34 in order to establish a connection between the thin film resistors 61 to 66 and the extraction electrode layer 8. It is preferable that in view of improvement of moisture resistance that other than the through holes, only the upper electrode layer 5 and the solder terminal portions 111 and 112 are exposed from the insulating layer 7.

Next, the extraction electrode layer 8 connects the upper electrode layer 5 of the first variable capacitance element C1 and the one terminal forming portion 111, and connects two upper electrode layers 5 so that the second variable capacitance element C2 and the third variable capacitance element C3 are connected in series with each other, and the fourth variable capacitance element C4 and the fifth variable capacitance element C5 are connected in series with each other. Furthermore, the extraction electrode layers 8 extending across the variable capacitance elements C2 and C3 and across the variable capacitance elements C4 and C5 are connected to the conductor lines 33 and 34 via the through holes of the insulating layer 7, respectively. As the material of the extraction electrode layer 8, it is preferable to use a low-resistance metal such as Au or Cu. An adhesice layer made of Ti, Ni or the like may be used, in consideration of the adhesiveness between the extraction electrode layer 8 and the insulating layer 7.

Next, the protecting layer 9 is formed so as to cover the whole with the solder terminal portions 111 and 112 exposed. The protecting layer 9 serves to protect the components of the variable capacitance capacitor Ct including the variable capacitance element C1 mechanically and from contamination due to chemicals or the like. However, when forming the protecting layer 9, formation is performed such that the solder terminal portions 111 and 112 are exposed. As a material of the protecting layer 9, a material having high heat resistance and excellent coatability with respect to steps is preferable. Specific examples thereof include a polyimide resin, a BCB (benzocyclobutene) resin or the like. The protecting layer 9 can be formed by applying raw material of resin and curing the materials at a predetermined temperature.

The solder diffusion preventing layer 10 is formed to prevent the solder of the solder terminal portions 111 and 112 from being diffused to the lower electrode layer 2 at the time of reflow when forming the solder terminal portions 111 and 112 or mounting. As the material of the solder diffusion preventing layer 10, Ni is favorable. Moreover, Au, Cu or other substances having high wettability with solder may be formed to a thickness of approximately 0.1 μm on the surface of the solder diffusion preventing layer 10 in order to improve the solder wettability.

Finally, the solder terminal portions 111 and 112 are formed. The solder terminal portions are formed to facilitate mounting to a wiring board outside the variable capacitance capacitor Ct. In general, the solder terminal portions 111 and 112 are formed by printing a solder paste on a portion where a portion where the solder terminal portions 111 and 112 are to be formed, using a predetermined mask and then performing reflow.

According to the variable capacitance capacitor Ct described above, the thin film resistors 61 to 66 containing tantalum nitride and having a specific resistance of 1 mΩ·cm or more is used in the first and second bias lines B11, B12, B13, B21, B22 and B23 or a portion thereof, so that the aspect ratio of the thin film resistors 61 to 66 is reduced and thus a compact variable capacitance capacitor Ct is realized. Further, the first and second bias lines B11, B12, B13, B21, B22 and B23 are formed directly on the support substrate 1, so that the number of the layers constituting each element such as the variable capacitance element C1 is reduced. Besides, since the process of forming the conductor layers, the dielectric layers and other layers constituting each element is performed in common with other elements, the variable capacitance capacitor can be formed in a simple manner, although the configuration is relatively complex.

Figure 6:
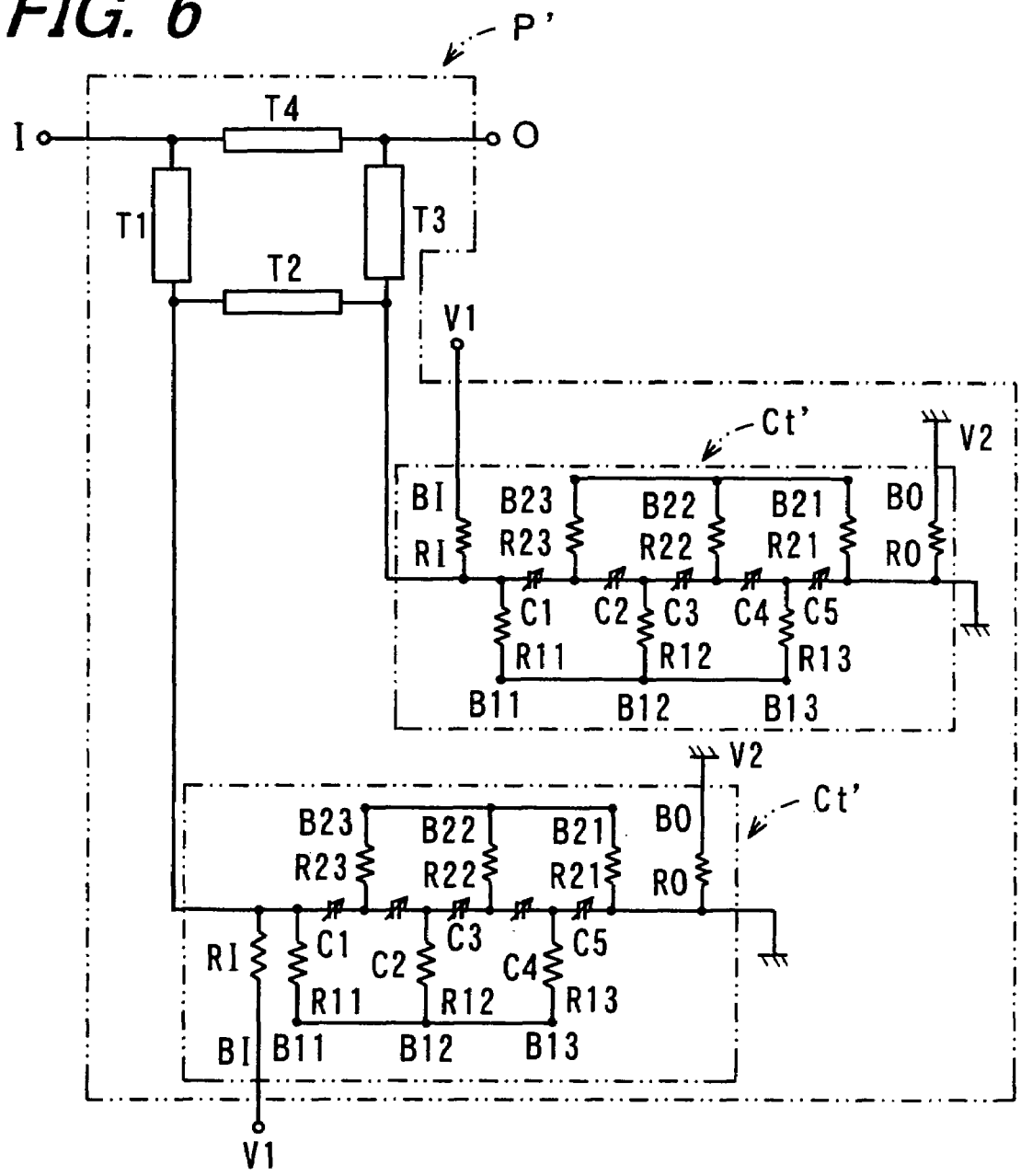
FIG. 6 is an equivalent circuit diagram showing another example of the variable phase shifter used in the array antenna of the invention.
Figure 7:
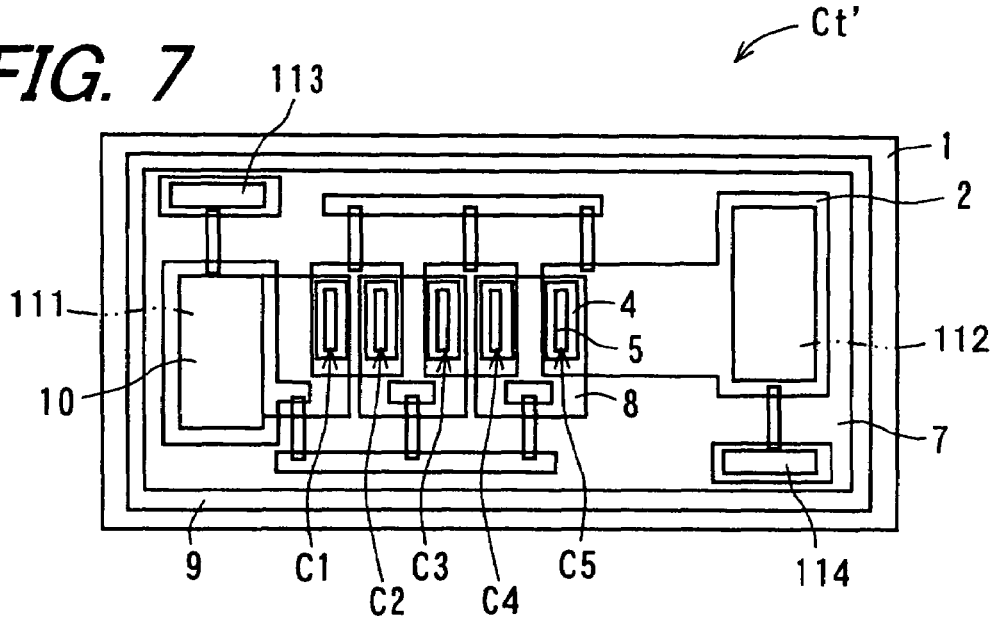
FIG. 7 is a plan view in a sight-through state showing an example of a variable capacitance capacitor including a bias supply circuit.
Figure 8:
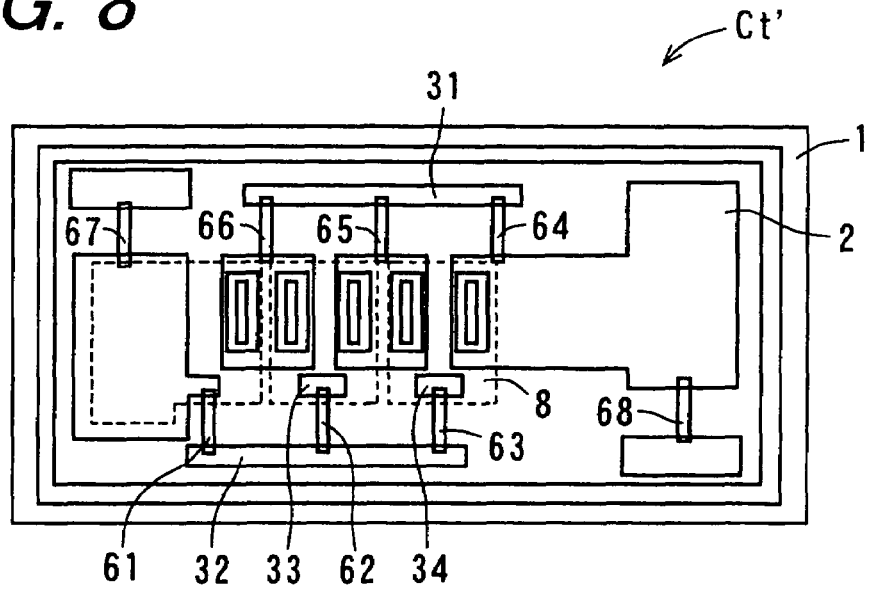
FIG. 8 is a plan view showing a state on the way of producing the variable capacitance capacitor shown in FIG. 7.

Next, FIGS. 6 to 8 show another example of the variable phase shifter used in the array antenna of the invention, and FIG. 6 is an equivalent circuit diagram of a 90-degree hybrid variable phase shifter P' using the variable capacitance capacitor Ct' having the five variable capacitance elements which variable capacitance capacitor has a bias supply circuit.

Moreover, FIG. 7 is a plan view in a sight-through state showing an example of the variable capacitance capacitor Ct' having the bias supply circuits, and FIG. 8 is a plan view showing a state on the way of production thereof. In these drawings, the same portions as in FIGS. 3 to 5 are denoted by the same reference numerals, and a repeated description thereof will be omitted.

In the equivalent circuit diagram shown in FIG. 6, reference numerals C1, C2, C3, C4 and C5 denote variable capacitance elements, respectively, reference numerals B11, B12 and B13 denote first bias lines each including at least one of a resistance component and an inductor component (resistance components R11, R12 and R13 are shown in the drawing), reference numerals B21, B22 and B23 denote second bias lines each including at least one of a resistance component and an inductor component (resistance components R21, R22 and R23 are shown in FIG. 6), and reference numerals BI and BO denote first and second common bias lines serving as bias supply circuits each including at least one of a resistance component and an inductor component, respectively (resistance components RI and RO are shown in FIG. 6). Moreover, reference numeral V1 denotes a first bias terminal, that is, a terminal on a side from which a bias signal is supplied, and reference numeral V2 denotes a second bias terminal, that is, a terminal from which the bias signal applied to the variable capacitance elements C1, C2, C3, C4 and C5 is sent off to the ground.

In a variable capacitance capacitor Ct' thus configured, a high frequency signal flows between the input terminal and the output terminal of the variable capacitance capacitor Ct' via the variable capacitance elements C1 to C5 that are connected in series with each other. At this moment, the resistance components R11, R12 and R13 of the first bias lines B11, B12 and B13 and the resistance components R21, R22 and R23 of the second bias lines B21, B22 and B23 become large impedance components compared to the impedance of the variable capacitance elements C1 to C5 in a frequency region of the high frequency signals, and do not affect adversely the impedance of the high frequency band.

Further, the resistance component RI of the first common bias line BI and the resistance component RO of the second common bias line BO become large impedance components compared to the impedance of the combined capacitance of the variable capacitance elements C1 to C5 in a frequency region of the high frequency signals, and do not affect adversely the impedance of the high frequency band.

Still further, the bias signals that control the capacitance component of the variable capacitance capacitor Ct' are supplied from the first bias terminal V1 and flow to the second bias terminal V2 (a ground in FIG. 6) via the variable capacitance element C1. the variable capacitance element C1 has a predetermined dielectric constant, depending on the voltage t be applied to the variable capacitance element C1, and consequently, a desired capacitance component can be obtained. The same applies to the variable capacitance elements C2 to C5.

As a result, it a bias signal for controlling the capacitance of the variable capacitance elements C1 to C5 to desired value can be supplied individually to each of the variable capacitance elements C1 to C5 in a stable manner, and the dielectric constant in the thin film dielectric layer of the variable capacitance elements C1 to C5 that depends on a bias signal applied can be changed as desired. Thus, in the variable capacitance capacitor Ct', the capacitance component can be controlled easily. Consequently, it is possible to set to a desired phase shifting amount with the variable capacitance capacitor Ct', and it is possible to change to a desired phase shifting amount with the variable phase shifter P' used in the array antenna of the invention.

That is to say, high frequency signals inputted to the variable capacitance elements C1 to C5 do not leak via the resistance components R11, R12 and R13 of the first bias lines B11, B12 and B13, the resistance components R21, R22 and R23 of the second bias lines B21, B22 and B23, and the resistance component RI of the first common bias line BI and the resistance component RO of the second common bias line BO. This makes it possible that a bias signal is applied independently to the variable capacitance elements C1 to C5 in a stable manner. As a result, the capacitance change ratio of each of the variable capacitance elements C1 to C5 that depends on the bias signal can be utilized to the maximum.

Further, in the variable capacitance capacitor Ct', N variable capacitance elements (N is an integral number of 2 or more), herein, the five variable capacitance elements C1 to C5 can be regarded as variable capacitance elements connected in series with each other with respect to high frequency component.

Therefore, a high frequency voltage applied to the variable capacitance elements C1 to C5 that are connected in series with each other is divided into each of the variable capacitance elements C1 to C5, so that the high frequency voltages applied to each of the variable capacitance elements C1 to C5 is reduced. Thus, in each individual variable capacitance elements C1 to C5, the capacitance variation with respct to the high frequency signals can be suppressed to be a small, and it is possible to suppress a waveform distortion, an intermodulation distortion and the like of the array antenna provided with the variable phase shifter P' using the variable capacitance capacitor Ct' with the variable capacitance elements C1 to C5.

Further, since the variable capacitance elements C1 to C5 are connected in series, the same effect as in the case of increasing the thickness of the dielectric layer can be obtained with respect to high frequency component, it is possible to reduce a heat generation amount per unit volume due to the loss resistance of the variable capacitance capacitor Ct', and it is possible to increase the high power handling capability of the variable phase shifter P'.

Still further, the bias supply circuit is provided in the variable capacitance capacitor Ct', so that a conventionally used external bias supply circuit is not necessary, and therefore the variable phase shifter P' can be compact and can be handled with ease.

When V2 is grounded to the ground, the second common bias line BO does not need to be always disposed. Moreover, the direct current limitation capacitance element is omitted.

Next, a method for producing the variable capacitance capacitor Ct' in this embodiment will be described.

In FIGS. 7 and 8, the variable capacitance capacitor comprises a support substrate 1, a lower electrode layer 2, conductor lines 31, 32, 33 and 34, a thin film dielectric layer 4, an upper electrode layer 5, thin film resistors 61, 62, 63, 64, 65 and 66, an insulating layer 7, an extraction electrode layer 8, a protecting layer 9, a solder diffusion preventing layer 10, and solder terminal portions 113, 112, 113 and 114. The solder diffusion preventing layer 10 and the solder terminal portion 111 compose a first signal terminal (an input terminal), and the solder diffusion preventing layer 10 and the solder terminal portion 112 compose a second signal terminal (an output terminal). Moreover, the first bias terminal V1 and the second bias terminal V2 are produced at the same time when the lower electrode layer 2 is formed. The first bias terminal V1 is constituted by the solder diffusion preventing layer 10 and the solder terminal portion 113, and second bias terminal V2 is constituted by the solder diffusion preventing layer 10 and the solder terminal portion 114.

The first common bias line BI is disposed between the first bias terminal V1 and the first signal terminal. The second common bias supply line BO is disposed between the second bias terminal V2 and the second signal terminal. The first common bias line BI and the second common bias line BO in this embodiment are constituted by thin film resistors 67 and 68, respectively.

As a material of the thin film resistors 67 and 68 constituting the first and second common bias lines BI and BO, a material containing tantalum (Ta) and having a specific resistance of 1 mΩ·cm or more is preferable. Specific examples thereof include tantalum nitride, TaSiN and Ta—Si—O. For example, in the case of tantalum nitride, the thin film resistors 67 and 68 having desired composition ratio and specific resistance can be formed by reactive sputtering in which sputtering is performed with nitride added, using Ta as a target.

By properly selecting the conditions of the sputtering, the thin film resistors 67 and 68 having a thickness of 40 nm or more and specific resistance of 1 mΩ·cm or more can be formed. Moreover, after the sputtering ends, patterning can be performed in a simple manner by performing etching process such as reactive ion etching (RIE) after a resist is applied and processed to a predetermined shape.

When the variable capacitance capacitor Ct' is used at a frequency of 1 GHz, and the capacitance thereof is set to 1 pF, and the thin film resistors 67 and 68 are set to have a resistance 100 times or more as large as the impedance so that the impedance is not adversely affected in this frequency, then it is sufficient that the necessary resistance of the first and second common bias lines BI and BO is approximately 16 kΩ or more. It is preferable that the specific resistivity of the thin film resistors 61 to 66 in the variable capacitance capacitor Ct' is 1 mΩ·cm or more, and therefore, for example, when 20 kΩ is to be obtained as the resistance of the first and second common bias lines BI and BO, the aspect ratio (length/width) of each of the thin film resistors 67 and 68 can be 100 or less at a thickness of 50 nm. Therefore, the thin film resistors 67 and 68 can have a realizable aspect ratio without increasing the size of the element shape.

Further, the insulating layer 7 is necessary to ensure insulation with the extraction electrode layer 8 formed thereon and the lower electrode layer 2. Moreover, the insulating layer 7 covers the first and second common bias lines BI and BO and the first and second bias lines B11, B12, B13, B21, B22 and B23, and can prevent the thin film resistors 61 to 68 from being oxidized. Thus, the resistance of the first and second common bias lines BI and BO and the first and second bias lines B11, B12, B13, B21, B22 and B23 can be made constant over time, and consequently, reliability can be improved. The material of the insulating layer 7 preferably contains at least one selected from silicon nitride and silicon oxide in order to improve moisture resistance. It is preferable to form the insulating layer by a chemical vapor deposition (CVD) or the like in consideration of the coatability.

Further, the insulating layer 7 can be processed to a desired shape by dry etching using a regular resist. Then, the insulating layer 7 is provided with through holes reaching the conductor lines 33 and 34 in order to expose portions of the conductor lines 33, 34 to establish a connection between the thin film resistors 61 to 66 and the extraction electrode layer 8. It is preferable that in view of improvement of moisture resistance that other than the through holes, only the upper electrode layer 4 and the solder terminal portions 111, 112, 113 and 114 are exposed from the insulating layer 7.

Further, the protecting layer 9 is formed so as to cover the whole with the solder terminal portions 113 and 114 exposed. The protecting layer 9 serves to protect components of the variable capacitance capacitor Ct' including the variable capacitance element C1 mechanically and from contamination due to chemicals or the like. However, when forming the protecting layer 9, formation is performed such that the solder terminal portions 113 and 114 are exposed. As the material of the protecting layer 9, a material having high heat resistance and excellent coatability with respect to steps is preferable. Specific examples thereof include a polyimide resin, a BCB (benzocyclobutene) resin. The protecting layer can be formed by applying raw materials of resin and curing the materials at a predetermined temperature.

The solder diffusion preventing layer 10 is formed to prevent the solder of the solder terminal portions 113 and 114 from being diffused to the lower electrode layer 2 at the time of reflow when forming the solder terminal portions 113 and 114. As the material of the solder diffusion preventing layer 10, Ni is favorable. Moreover, Au, Cu or other substances having high wettability with solder may be formed to a thickness of approximately 0.1 μm on the surface of the solder diffusion preventing layer 10 in order to improve the solder wettability.

Finally, the solder terminal portions 113 and 114 are formed. The solder terminal portions 113 and 114 are formed to facilitate mounting to a wiring board outside the variable capacitance capacitor Ct'. In general, the solder terminal portions 113 and 114 are formed by printing a solder paste on a portion where the solder terminal portions 113 and 114 are to be formed, using a predetermined mask and then performing reflow.

According to the variable capacitance capacitor Ct' described above, the thin film resistors 61 to 68 containing tantalum nitride and having a specific resistance of 1 mΩ·cm or more is used in the first and second common bias lines BI and BO and the first and second bias lines B11, B12, B13, B21, B22 and B23 or a portion thereof, so that the aspect ratio of each of the thin film resistors 61 to 68 is reduced and thus a compact variable capacitance capacitor is realized. Further, the first and second common bias lines BI and BO and the first and second bias lines B11, B12, B13, B21, B22 and B23 are formed directly on the support substrate 1, so that the number of layers constituting each element such as the variable capacitance element C1 is reduced. Besides, since the process of forming the conductor layer, the dielectric layer and other layer constituting each element is performed in common with other elements, the variable capacitance capacitor can be formed in a simple manner, although the configuration is relatively complex.

Further, according to the array antenna 100 of the invention, the variable phase shifters P and P' having the variable capacitance capacitors Ct and Ct' configured the above are inserted midway between the feeding lines 12 and 13. Since in the variable capacitance capacitor used in the variable phase shifter P and P', the plurality of variable capacitance elements such as C1 are connected in series with each other with respect to high frequency component, a high frequency voltage applied to the variable capacitance elements such as C1 is divided into the respective variable capacitance elements such as C1. Thus, high frequency voltages applied to the individual variable capacitance elements decrease because of the division, and consequently, it is possible to hold down a capacitance variation with respect to a high frequency signal of the variable capacitance capacitor Ct and Ct' so as to be small. Therefore, it is possible to extensively restrain a waveform distortion, an intermodulation distortion and the like of the variable phase shifter P and P', and it is possible to improve distortion characteristics of the array antenna. In addition, according to the array antenna of the invention, in the variable capacitance capacitor Ct and Ct' used in the variable phase shifter P and P', the plurality of variable capacitance elements such as C1 are connected in series with each other with respect to high frequency component, so that it is possible to obtain the same effect as in the case of increasing film thickness of the dielectric layer of the variable capacitance element, and it is possible to reduce a heat generation amount per unit volume due to a loss resistance of the variable capacitance capacitor. As a result, high power handling capability of the variable phase shifter increases, and it is possible to improve a high power handling capability characteristic as the array antenna.

Further, according to the array antenna 100 of the invention, the plurality of the variable capacitance elements such as C1 using the thin film dielectric layer whose dielectric constant changes in accordance with an application voltage is used in the variable capacitance capacitors Ct and Ct'. Thus, it is possible to reduce a loss in the variable capacitance capacitor even at high frequencies, a passing characteristic of the variable phase shifters P and P' is improved, and attending thereon, it is possible to improve a passing characteristic of the array antenna.

Furthermore, according to the array antenna 100 of the invention, when the variable capacitance capacitor Ct' used in the variable phase shifter P' has the bias supply circuit connected to the electrodes of the plurality of variable capacitance elements such as C1 and each including at least one of the resistance component and the inductor component, an independent bias supply circuit mounted on an external wiring board as in the related variable phase shifting circuit becomes unnecessary, and miniaturization of the variable phase shifting is realized, so that it becomes possible to miniaturize the array antenna as a whole, and it becomes easy to handle the array antenna using the variable phase shifter.

From the above, according to the invention, it is possible to provide the array antenna provided with the variable phase shifter that is stable and has a small waveform distortion and intermodulation distortion, excellent high power handling capability and a low loss. Further, it is possible to provide the array antenna that does not need the independent bias supply circuit and that are provided with the variable phase shifter that is small in size and easy to handle.

Then, a radio communication apparatus (not shown) of the invention comprises the array antenna 100 of the invention as described above, and at least one of a transmission circuit and a reception circuit, the one being connected to the array antenna 100.

Further, in order to make radio communications possible when desired, a radio signal processing circuit may be connected to the array antenna 100, the transmission circuit or the reception circuit, and a variety of other configurations can be adopted.

Besides, according to the invention, the radio communication apparatus comprises the array antenna 100 of the invention as above, and at least one of the transmission circuit and the reception circuit, the one being connected to the array antenna 100. Thus it becomes possible, by the array antenna 100 provided with the variable phase shifter that is stable and has a small waveform distortion and intermodulation distortion, excellent high power handling capability, low-loss, to use a transmitter or a transmission circuit that handle large electric power, and it is possible to realize the radio communication apparatus which can reduce deterioration of the quality of communications due to multipath, a Doppler shift and the like. Moreover, since the configuration of the antenna can be miniaturized, the radio communication apparatus provided with the array antenna 100 also can be miniaturized, and then can be used as a mobile radio equipment.

Figure 9:
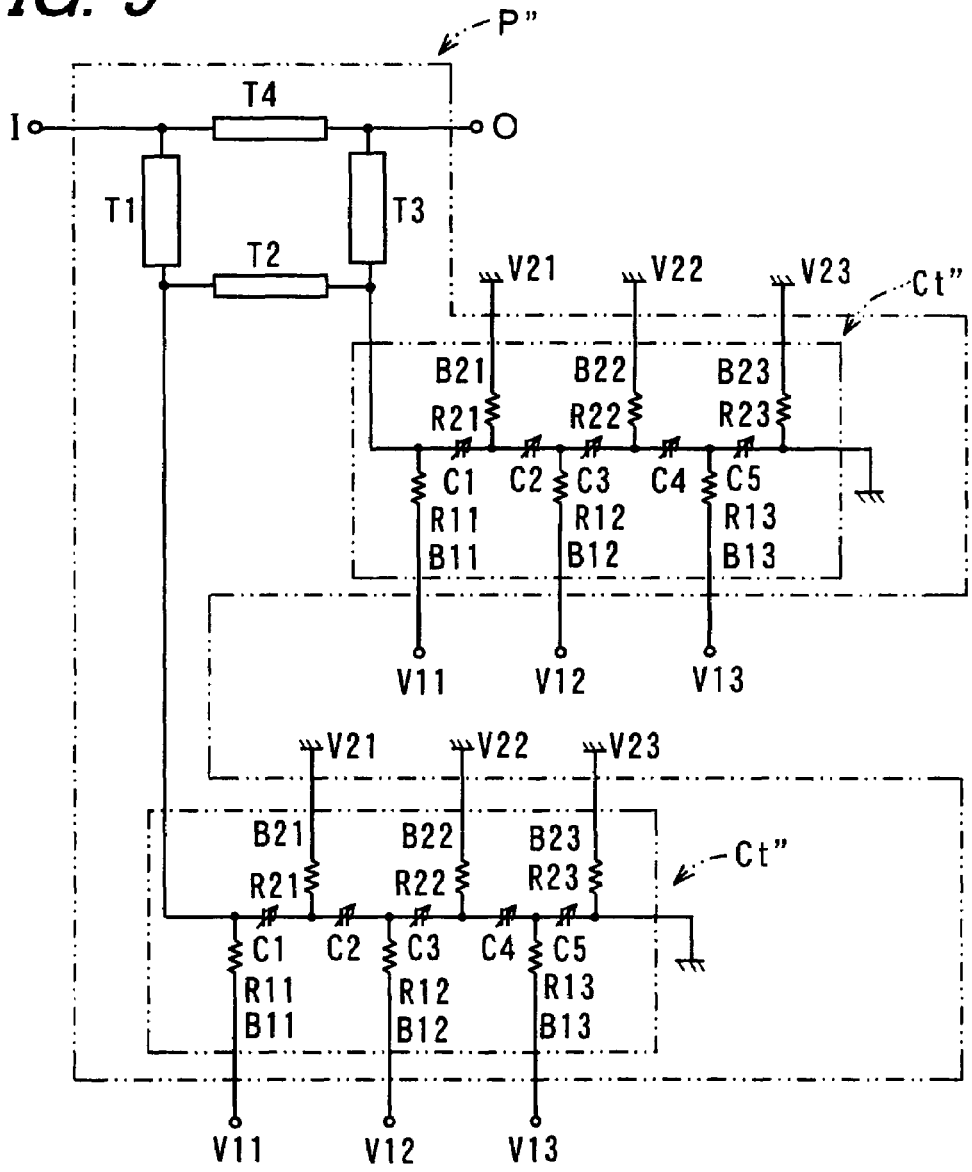
FIG. 9 is an equivalent circuit diagram showing still another example of the variable phase shifter used in the array antenna of the invention provided with the bias supply circuits, individually.

The invention is not restricted to the embodiments described above, and there is nothing against adding various changes within the scope of the invention. For example, the first and second common bias lines BI and BO serving as the bias supply circuits are common in the aforementioned embodiments, as shown in an equivalent circuit diagram showing still another example of the variable phase shifter used in the array antenna of the invention of FIG. 9. However, the invention may be an array antenna which is a variable phase shifter P" provided with a variable capacitance capacitor Ct" in which the bias lines B11, B12, B13, B21, B22 and B23, which constitute a bias supply circuit, are provided individually with respect to the respective variable capacitance elements C1, C2, C3, C4 and C5.

Figure 10:
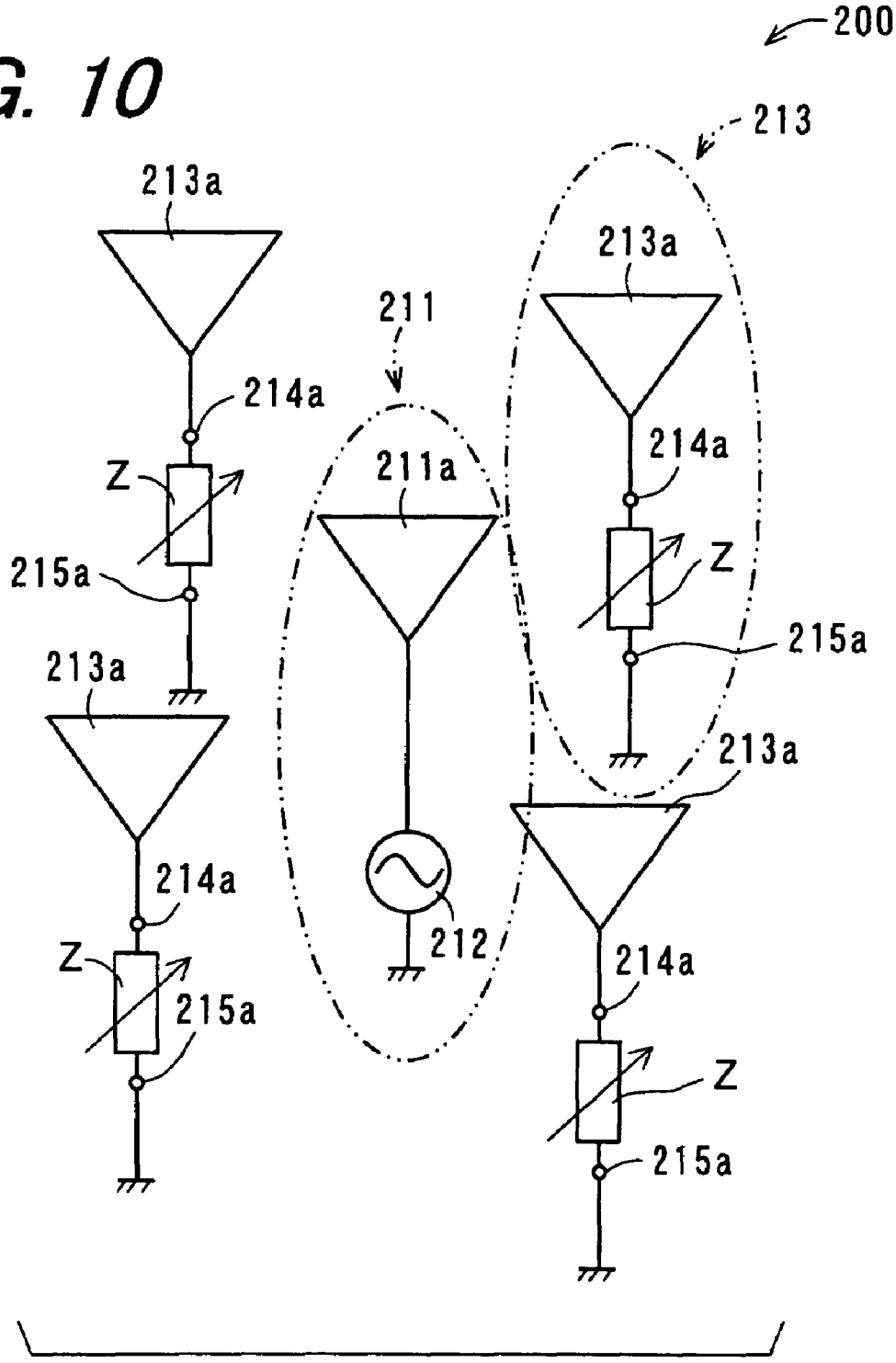
FIG. 10 is a circuit diagram schematically showing an array antenna according to a second embodiment of the invention.
Figure 11:
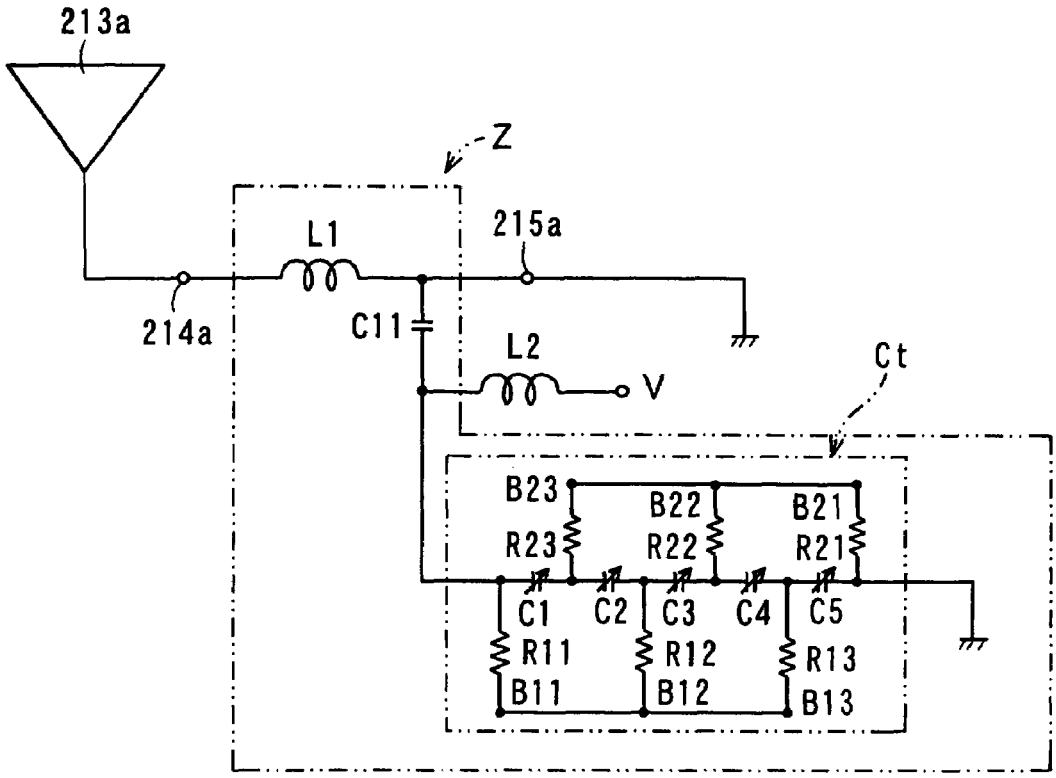
FIG. 11 is an equivalent circuit diagram showing an example of a variable reactance circuit loaded on an parasitic radiation element in the array antenna of the invention.

FIGS. 10 and 11 show an array antenna according to a second embodiment of the invention, respectively. FIG. 10 is a circuit diagram schematically showing the array antenna of the invention provided with a variable reactance circuit. Moreover, FIG. 11 is an equivalent circuit diagram of the variable reactance circuit loaded on a parasitic radiation element.

The array antenna of the invention shown in FIG. 10 comprises a radiation element 211*a* to which a power feeding source 212 is connected, a parasitic radiation element 213*a* fed by mutual coupling with the radiation element 211*a*, and a variable reactance circuit Z loaded on the parasitic radiation element 213*a*. In the circuit diagram shown in FIG. 10, the power feeding source 212 feeds electric power to the radiation element 211*a*. One end of the power feeding source 212 is connected to the radiation element 211*a*, and another end is grounded to a ground. Thus, a driven antenna 211 is configured. Moreover, one end of the variable reactance circuit Z is connected to an antenna terminal 214*a* of the parasitic radiation element 213*a*, and another end thereof is connected to a ground terminal 215*a* and grounded. Thus, a parasitic antenna 213 is configured. In the embodiment shown in FIG. 10, four sets of parasitic antennas 213 are placed about the driven antenna 211. Each of the parasitic radiation elements 213*a* is placed at a certain distance from the radiation element 211*a* and located so that the mutual coupling with the radiation element 211*a* occurs. With the configuration as described above, it is possible to obtain an array antenna 200 of the invention.

Here, a reason why a directivity can be variable in the array antenna 200 of the invention will be described in brief. The respective parasitic radiation elements 213*a* are placed so as to keep equal interelement interval with respect to the radiation element 211*a*. When the power feeding source 212 feeds the radiation element 211*a* that is surrounded by the respective parasitic radiation elements 213*a* and is located in the center thereof with electric power, by an effect of interelement mutual coupling, a voltage is induced in each of the parasitic radiation elements 213*a*, and a high frequency electric current is generated. Then, by controlling the high frequency electric current in each of the parasitic antennas 213 by changing a reactance value of the variable reactance circuit Z loaded on each of the parasitic radiation elements 213*a*, it becomes possible to make the directivity of the array antenna variable. Besides, here, the four sets of parasitic antennas 213 are placed, but in order to form a directivity variable width and a null point as desired, it is possible to place, for example, one or more sets and ten or less sets. Thus, it is possible to determine the number of the sets in consideration of a necessary directivity variable width and a total array antenna size.

In the equivalent circuit diagram shown in FIG. 11, one end of the variable reactance circuit Z is connected to the antenna terminal 214*a* of the parasitic radiation element 213*a*, and the other end thereof is grounded to the ground. Moreover, in the variable reactance circuit Z, reference numeral L1 denotes an inductor serving as an impedance element, one end thereof is connected in series to the antenna terminal 214*a*, and the other end thereof is connected to the ground terminal 215*a* and one end of a capacitance element C11. The capacitance element C11 is located as a direct current limitation capacitance element. Reference numeral L2 denotes a choke coil including an RF blocking inductance component for supplying a control voltage (a bias signal), and reference numeral Ct denotes a variable capacitance capacitor. The other end of the capacitance element C11 is connected to one end of the choke coil L2 and one end of the variable capacitance capacitor Ct. Another end of the choke coil L2 is connected to a bias terminal V, and the other end of the variable capacitance capacitor Ct is grounded to the ground.

By connecting the variable reactance circuit Z having the variable capacitance capacitor Ct to the parasitic radiation element 213*a* and loading thereon in this way, it becomes possible to control the high frequency electric current excited by the radiation element 211*a* in the parasitic radiation element 213*a* by regulating a capacitance component of the parasitic radiation element 213*a*.

Although an embodiment such that the variable reactance circuit Z is an LC low-pass type is shown here, it is possible to use by changing the configuration of the variable reactance circuit Z in accordance with an object within the scope of the invention so as to be, for example, an LC high-pass type, a n-type, a T-type or a multistage configuration having the variable capacitance capacitor Ct, and it is possible to obtain the same effect in any of the variable reactance circuits.

Further, as the radiation element 211*a* and the parasitic radiation element 213*a*, it is possible to use a general antenna such as a linear antenna and a planar antenna. Moreover, it is possible to use a whip antenna used in mobile equipment such as a recent mobile phone, and a microstrip antenna, a planar inverted-F antenna and the like that are built in cases. In particular, the microstrip antenna and the planar inverted-F antenna are favorable in respect of miniaturization, and it is possible to obtain the radiation element 211*a* and the parasitic radiation element 213*a* that are miniaturized, by forming a conductive material to become a radiation electrode on a base made of a dielectric material made of ceramics or an organic material or a magnetic material such as ferrite, by a crimping method, a pressing method, a plating method, a printing method or the like. The radiation element 211*a* and the parasitic radiation element 213*a* do not need to be identical, and the array antenna 200 of the invention may be configured by the use of different radiation elements.

In the equivalent circuit diagram of the variable reactance circuit Z shown in FIG. 11, reference numeral Ct denotes the variable capacitance capacitor. The configuration of the variable capacitance capacitor Ct of this embodiment is the same as the configuration of the variable capacitance capacitor Ct of the first embodiment of the invention, and the explanation thereof is omitted.

The bias signal that controls a capacitance component of the variable capacitance element C1 is supplied from the bias terminal V via the choke coil L2, and flows to the ground via the variable capacitance element C1. In accordance with a voltage applied to the variable capacitance element C1, the dielectric constant of the variable capacitance element C1 becomes a specified dielectric constant, with the result that a desired capacitance component can be obtained. Since the variable capacitance elements C2, C3, C4 and C5 are connected in parallel to each other with respect to direct current component via the first bias lines B11, B12 and B13 and the second bias lines B21, B22 and B23, a bias signal having the same size with respect to direct current component is also applied thereto so that a predetermined capacitance components can be obtained.

As a result, a direct current bias signal for controlling the capacitance of the variable capacitance elements C1, C2, C3, C4 and C5 to desired values can be supplied individually to each of the variable capacitance elements C1, C2, C3, C4 and C5 in a stable manner, and dielectric constant in a thin film dielectric layer of each of the variable capacitance elements C1, C2, C3, C4 and C5 that depends on a bias signal applied can be changed as desired. Thus, in the variable capacitance capacitor Ct, capacitance component can be controlled easily.

Consequently, the variable reactance circuit Z is composed of the L connected in series and the variable capacitance capacitor Ct connected in parallel, so that it is possible to control the reactance value of the radiation element 11*a* to which the variable reactance circuit Z is connected with the variable capacitance capacitor Ct. When the reactance value of the radiation element 11*a* is changed, by an effect of mutual coupling between the radiation element 11*a* and the parasitic radiation element 13*a*, a voltage is induced in each of the parasitic radiation elements 13*a*, a high frequency electric current is generated, and the high frequency electric current excited in the parasitic radiation element 13*a* can be regulated. Therefore, it becomes possible to make the directivity of the array antenna variable.

Further, a high frequency voltage applied to the variable capacitance elements C1, C2, C3, C4 and C5 connected in series with each other is divided into each of the variable capacitance elements C1, C2, C3, C4 and C5, so that a high frequency voltage applied to each of the variable capacitance elements C1, C2, C3, C4 and C5 decreases. Consequently, it is possible to restrain a capacitance variation with respect to the high frequency signals to be small one, it is possible to change the reactance value of the variable reactance circuit Z to a desired reactance value with high accuracy, and it is possible to suppress a waveform distortion, an intermodulation distortion and the like.

Further, because the variable capacitance elements C1, C2, C3, C4 and C5 are connected in series with each other, the same effect as in the case of increasing the thickness of the dielectric layer of the capacitance element is obtained with respect to high frequency component, it is possible to make a heat generation amount per unit volume due to a loss resistance of the variable capacitance capacitor Ct to be small, and it is possible to increase high power handling capability of the variable reactance circuit Z. As a result, it is possible to obtain the array antenna 200 that is capable of handling large electric power.

Next, an example of a method for producing the variable capacitance capacitor Ct used in the variable reactance circuit Z composing the array antenna 200 of the invention is the same as the method for producing the variable capacitance capacitor Ct of the first embodiment of the invention, and the explanation thereof is omitted.

Figure 12:
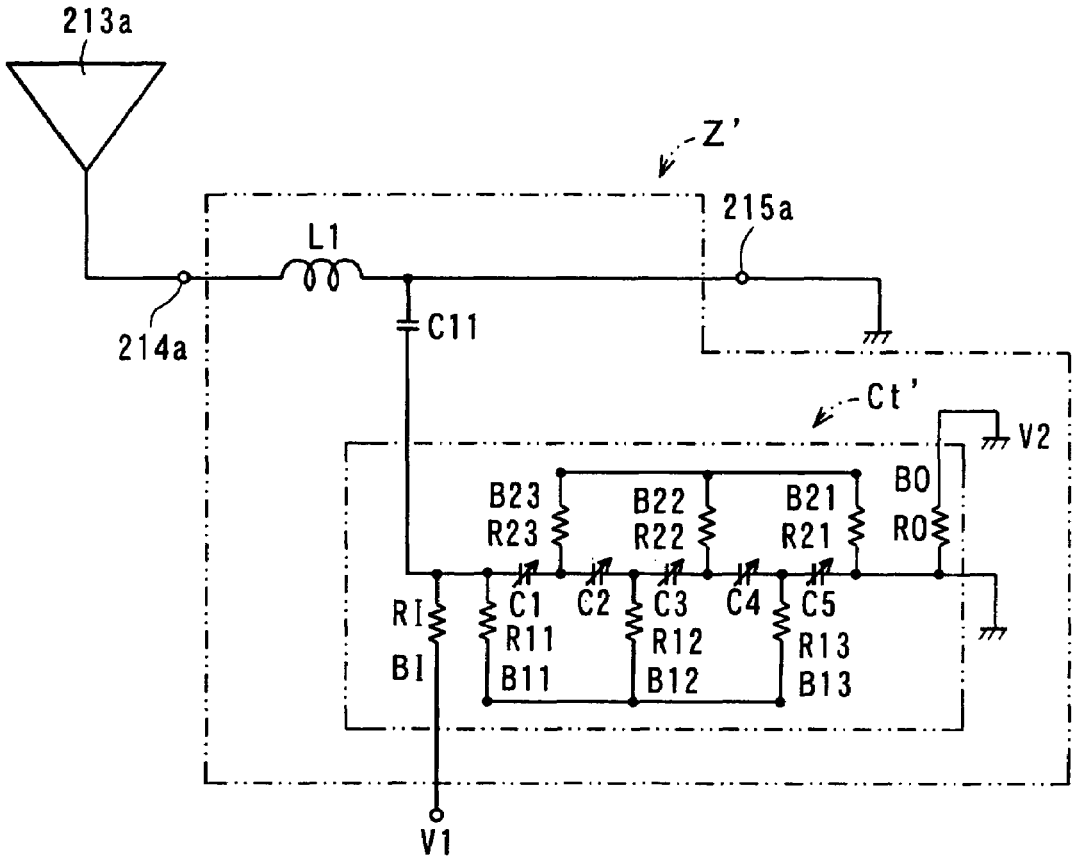
FIG. 12 is an equivalent circuit diagram showing another example of the variable reactance circuit loaded on the parasitic radiation element in the array antenna of the invention.

Next, FIG. 12 shows another example of the variable reactance circuit loaded on the parasitic radiation element in the array antenna of the invention, and FIG. 12 is an equivalent circuit diagram of an LC low-pass-type variable reactance circuit Z' using a variable capacitance capacitor Ct' that has bias supply circuits and has five variable capacitance elements. In FIG. 12, the same portions as in FIGS. 10 and 11 are denoted by the same reference numerals, and a repeated description thereof will be omitted.

In the equivalent circuit diagram shown in FIG. 12, the configuration of the variable capacitance capacitor Ct' of this embodiment is the same as the configuration of the variable capacitance capacitor Ct' of the first embodiment of the invention, and the explanation thereof is omitted.

The bias signal that controls a capacitance component of the variable capacitance capacitor Ct' is supplied from the first bias terminal V1, and flows to the second bias terminal V2 (a ground in FIG. 12) via the variable capacitance element C1. The dielectric constant of the variable capacitance element C1 becomes a specified dielectric constant in accordance with a voltage applied to the variable capacitance element C1, with the result that a desired capacitance component can be obtained. The same applies to the variable capacitance elements C2 to C5.

As a result, it a bias signal for controlling the capacitance of the variable capacitance elements C1 to C5 to desired value can be supplied individually to each of the variable capacitance elements C1 to C5 in a stable manner, and the dielectric constant in the thin film dielectric layer of the variable capacitance elements C1 to C5 that depends on a bias signal applied can be changed as desired. Thus, in the variable capacitance capacitor Ct', the capacitance component can be controlled easily. Consequently, it is possible to obtain the array antenna of the invention that, by controlling a reactance value of a variable reactance circuit Z' to a desired value with the variable capacitance capacitor Ct', can regulate a high frequency electric current excited in the parasitic radiation element 213*a* by the radiation element 211*a* and that is capable of making directivity variable.

Further, a high frequency voltage applied to the variable capacitance elements connected in series with each other is divided into each of the variable capacitance elements C1 to C5, so that the high frequency voltages applied to the individual variable capacitance elements C1 to C5 decrease. Thus, it is possible to restrain a capacitance variation with respect to the high frequency signals in the individual variable capacitance elements C1 to C5 to be a small one, and it is possible to suppress a waveform distortion, an intermodulation distortion and the like of the variable reactance circuit Z' using the variable capacitance capacitor Ct' with the variable capacitance elements C1 to C5.

Further, since the variable capacitance elements C1 to C5 are connected in series, the same effect as in the case of increasing the thickness of the dielectric layer can be obtained with respect to high frequency component, it is possible to reduce a heat generation amount per unit volume due to the loss resistance of the variable capacitance capacitor Ct', and it is possible to increase the high power handling capability of the variable reactance circuit Z'. As a result, it is possible to obtain the array antenna that is capable of handling large electric power.

Still further, the bias supply circuit is provided in the variable capacitance capacitor Ct', so that a conventionally used external bias supply circuit is not necessary, and therefore the variable reactance circuit Z' can be compact and can be handled with ease.

When V2 is grounded to the ground, the second common bias line BO does not need to be always disposed.

Next, a method for producing the variable capacitance capacitor Ct' in this embodiment is the same as the method for producing the variable capacitance capacitor Ct' in the first embodiment of the invention, and the explanation thereof is omitted.

According to the array antenna 200 of the invention, the variable reactance circuit Z, Z' that has the variable capacitance capacitor Ct, Ct' produced as described above is connected between the antenna terminal 214*a* of the parasitic radiation element 213*a* and the ground terminal 215*a*. Since in the variable capacitance capacitor Ct, Ct' of the variable reactance circuit Z, Z', the elements such as the plurality of variable capacitance elements C1 and so on are connected in series with each other with respect to high frequency component, a high frequency voltage applied to the plurality of variable capacitance elements C1 and so on is divided into each of the variable capacitance elements C1 and so on. Therefore, a high frequency voltage applied to each of the variable capacitance elements becomes small because of division, with the result that it is possible to restrain a capacitance variation with respect to a high frequency signal of the variable capacitance capacitor Ct, Ct' to a small one. Therefore, it is possible to suppress a waveform distortion, an intermodulation distortion and the like of the parasitic radiation element 213*a*, and consequently, it is possible to suppress a waveform distortion, an intermodulation distortion and the like of the array antenna 200. In addition, since the plurality of variable capacitance elements C1 and so on are connected in series with each other with respect to high frequency component, the same effect as in the case of increasing film thickness of the dielectric layer of the variable capacitance element can be obtained, it is possible to reduce a heat generation amount per unit volume due to a loss resistance of the variable capacitance capacitor Ct, Ct', and it is possible to increase high power handling capability of the variable reactance circuit Z, Z'. As a result, it is possible to obtain the array antenna 200 that is capable of handling large electric power.

Further, according to the array antenna 200 of the invention, the plurality of variable capacitance elements C1 and so on each using the thin film dielectric layer whose dielectric constant changes in accordance with an applied voltage are used in the variable capacitance capacitor Ct, Ct' used in the variable reactance circuit Z, Z' connected between the antenna terminal 214*a* of the parasitic radiation element

213*a* and the ground terminal 215*a*. Thus, it is possible to make a loss in the variable capacitance capacitor Ct, Ct' to be small even at high frequencies, so that it is possible to make a loss of the variable reactance circuit Z, Z' to be small, and consequently, it is possible to make a loss of the array antenna 200 to be small.

Furthermore, according to the array antenna 200 of the invention, when the variable capacitance capacitor Ct' has the bias supply circuit including at least one of the resistance component and the inductor component connected to the electrodes of the plurality of variable capacitance elements C1 and so on, an independent bias supply circuit mounted on an external wiring board in a conventional variable reactance circuit becomes unnecessary, so that it is possible to miniaturize the parasitic radiation element 213*a*, and it is possible to obtain the array antenna 200 that can be operated more easily.

From the above, according to the invention, it is possible to change the directivity of the array antenna with ease and stability, so that it is possible to provide the array antenna that has a small waveform distortion and intermodulation distortion, excellent high power handling capability and low-loss, and is of low-price and simply configured. Moreover, it is possible to provide the array antenna that does not need an independent bias supply circuit for a variable capacitance element and is easy to handle, and that is capable of directivity control.

Then, a radio communication apparatus (not shown) of the invention comprises the array antenna 200 of the invention as described above, and at least one of a transmission circuit and a reception circuit, the one being connected to the array antenna 200.

Further, in order to make radio communications possible when desired, a radio signal processing circuit may be connected to the array antenna 200, the transmission circuit or the reception circuit, and a variety of other configurations can be adopted.

According to the radio communication apparatus of the invention as described above, the radio communication apparatus comprises the array antenna 200 of the invention as described above, and at least one of the transmission circuit and the reception circuit connected thereto. Thus, it becomes possible to use a transmitter and a transmission circuit that handle large electric power with the array antenna 200 provided with a variable reactance circuit that is stable and has a small waveform distortion and intermodulation distortion, excellent high power handling capability and low-loss. Therefore, even in an area where multipath and a Doppler shift exist and a radio communication environment is unfavorable, radio communications become possible without deterioration of the quality of radio communications by controlling the directivity. Moreover, in the case of applying to a base station and a mobile station of mobile phones or the like, it becomes possible to make radio communications high speed and large capacity, increase the quality of radio communications, realize high speed mobile communications, and so on, a lot of users can use simultaneously because the use efficiency of a frequency increases, and it is possible to provide a small size and high performance radio communication apparatus.

Figure 13:
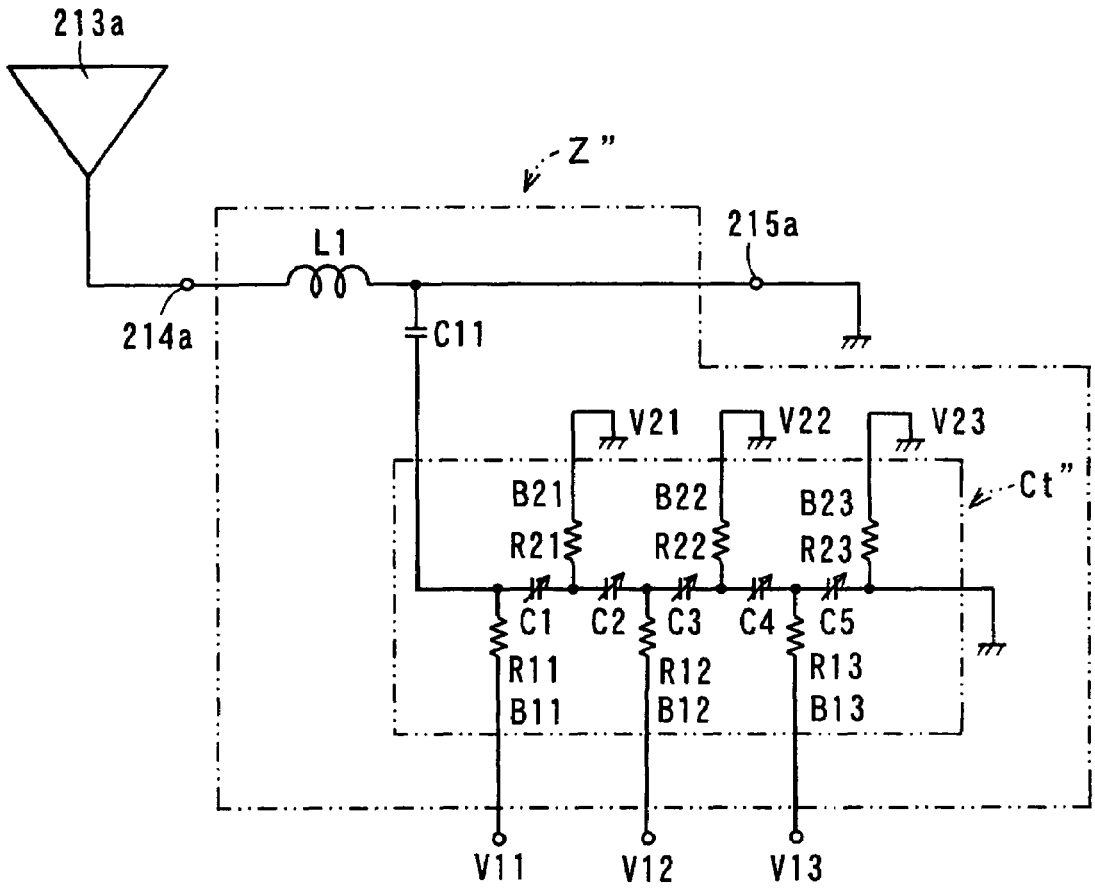
FIG. 13 is an equivalent circuit diagram showing still another example of the variable reactance circuit loaded on the parasitic radiation element in the array antenna of the invention provided with the bias supply circuits, individually.
Figure 14:
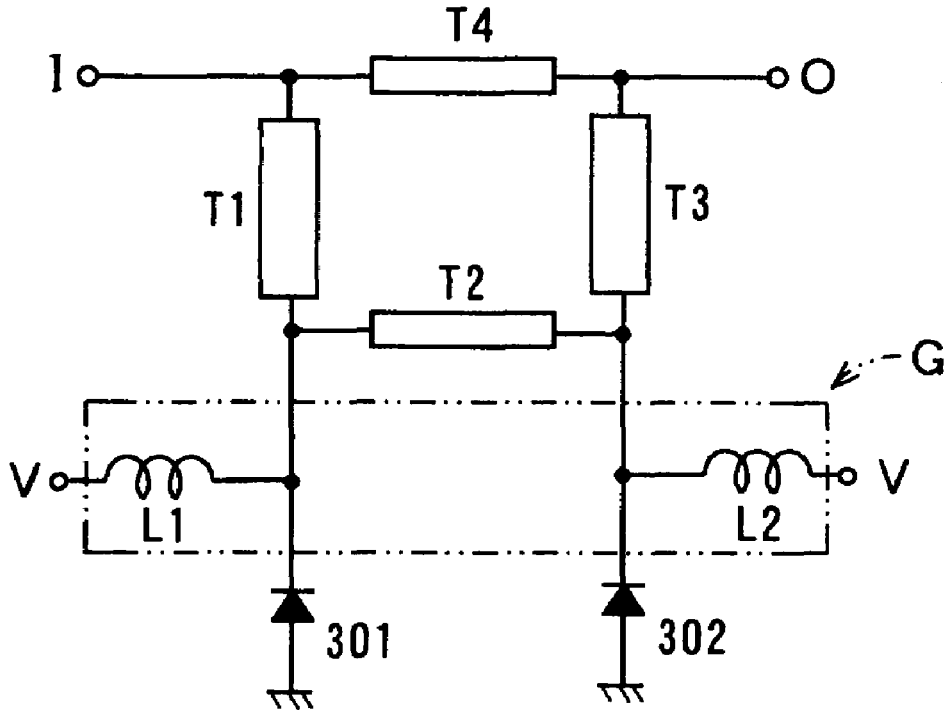
FIG. 14 PRIOR ART
FIG. 14 is an equivalent circuit diagram showing an example of a related variable phase shifting circuit.
Figure 15:
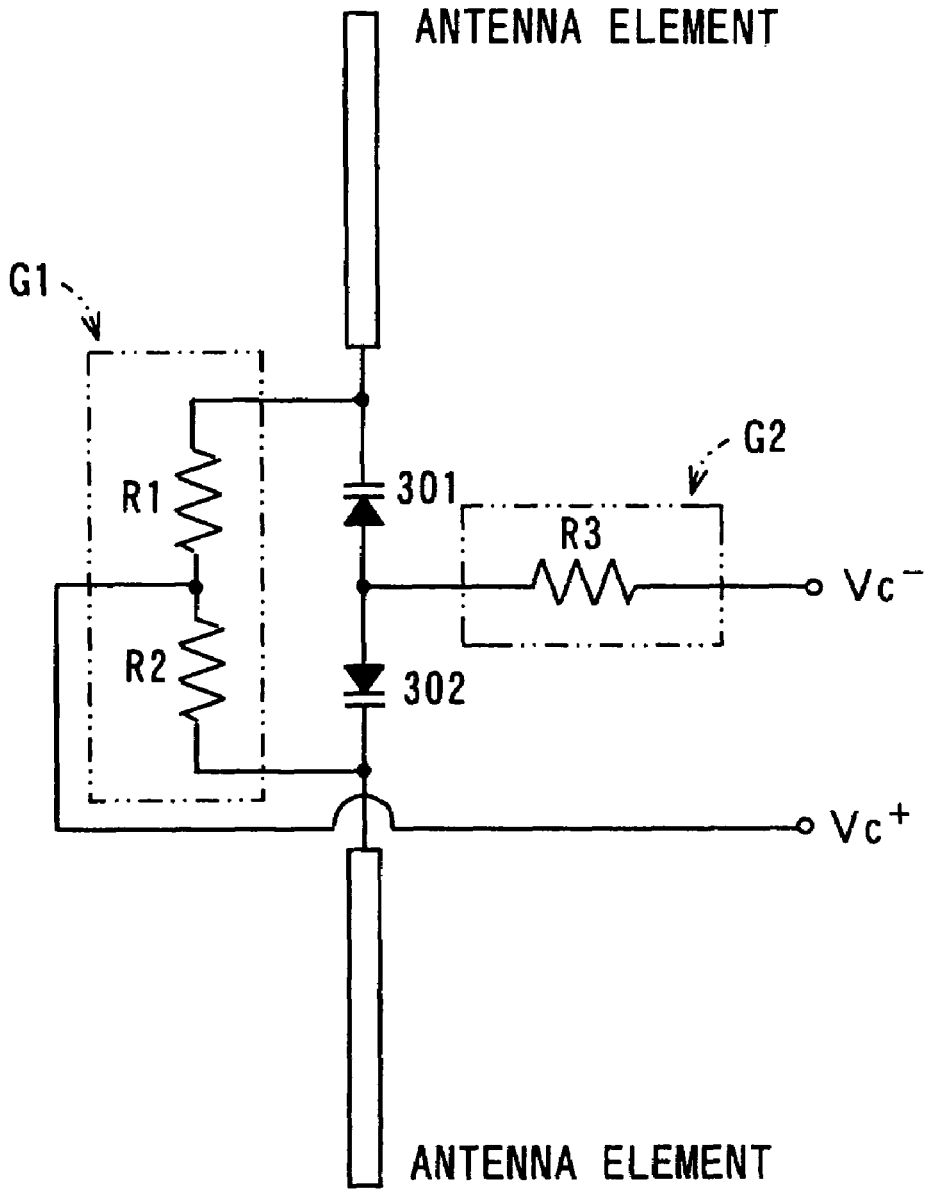
FIG. 15 PRIOR ART
FIG. 15 is an equivalent circuit diagram showing an example of a variable reactance circuit loaded on a dipole-type parasitic element of a related array antenna apparatus.

The invention is not restricted to the embodiments described above, and there is nothing against adding various changes within the scope of the invention. For example, the first and second common bias lines BI and BO serving as the bias supply circuits in the variable capacitance capacitor Ct, Ct' are common in the aforementioned embodiments. However, as shown in an equivalent circuit diagram showing still another example of the variable reactance circuit loaded on the parasitic radiation element in the array antenna of the invention of FIG. 13, a variable reactance circuit Z" may have a variable capacitance capacitor Ct" in which the bias lines B11, B12, B13, B21, B22 and B23, which constitute a bias supply circuit, are provided individually with respect to the respective variable capacitance elements C1, C2, C3, C4 and C5.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An array antenna comprising:

a plurality of radiation elements;

a plurality of feeding lines that feed electric power to the plurality of radiation elements; and variable phase shifters each inserted midway between the feeding lines, wherein the phase shifter has a transmission line or a circulator, a variable capacitance capacitor is connected to a round side of the transmission line or a ground side terminal of the circulator, and in the variable capacitance capacitor, a plurality of variable capacitance elements each using a thin film dielectric layer whose dielectric constant changes in accordance with an applied voltage are connected between an input terminal and an output terminal, in parallel to each other with respect to direct current component and in series with each other with respect to high frequency component.

2. The array antenna of claim 1, wherein the variable capacitance capacitor used in the variable phase shifter has a bias supply circuit that is connected to electrodes of the plurality of variable capacitance elements and includes at least one of a resistance component and an inductor component.

3. The array antenna of claim 1, wherein the radiation element is a microstrip antenna or a planar inverted-F antenna.

4. The array antenna of claim 1, wherein the plurality of radiation elements are connected in parallel to a single power feeding source by the plurality of feeding lines.

5. The array antenna of claim 1, wherein the thin film dielectric layer is a dielectric layer made of a perovskite oxide crystal containing at least Ba, Sr and Ti.

6. A radio communication apparatus comprising:

the array antenna of claim 1; and at least one of a transmission circuit and a reception circuit, the one being connected to the array antenna.

7. An array antenna comprising:

a radiation element to which a power feeding source is connected;

a parasitic radiation element fed by mutual coupling with the radiation element; and a variable reactance circuit loaded on the parasitic radiation element, wherein the variable reactance circuit has a variable capacitance capacitor, and in the variable capacitor, a plurality of variable capacitance elements each using a thin film dielectric layer whose dielectric constant changes in accordance with an applied voltage are connected between an input terminal and an output terminal, in parallel to each other with respect to direct current component and in senes with each other with respect to high frequency component.

8. The array antenna of claim 7, wherein the variable capacitance capacitor used in the variable reactance circuit has a bias supply circuit that is connected to electrodes of the plurality of variable capacitance elements and includes at least one of a resistance component and an inductor component.

9. The array antenna of claim 7, wherein the radiation element and the parasitic radiation element are a microstrip antenna or a planar inverted-F antenna.

10. The array antenna of claim 7, wherein the thin film dielectric layer is a dielectric layer made of a perovskite oxide crystal containing at least Ba, Sr and Ti.

11. A radio communication apparatus comprising:

the array antenna of claim 7; and at least one of a transmission circuit and a reception circuit, the one being connected to the array antenna.

* * * * *